US010125519B1

(12) United States Patent
Gengler et al.

(10) Patent No.: US 10,125,519 B1
(45) Date of Patent: Nov. 13, 2018

(54) WIRELESS-ENABLED INTERCHANGEABLE LOCKING CORE

(71) Applicant: Noke, Inc., Lehi, UT (US)

(72) Inventors: David P. Gengler, Draper, UT (US); Jay Ballard, Mapleton, UT (US)

(73) Assignee: NOKE, INC., Lehi, UT (US)

( * ) Notice: Subject to any disclaimer, the term of this patent is extended or adjusted under 35 U.S.C. 154(b) by 0 days.

(21) Appl. No.: 15/832,348

(22) Filed: Dec. 5, 2017

(51) Int. Cl.
*E05B 9/08* (2006.01)
*E05B 47/00* (2006.01)
*G07C 9/00* (2006.01)

(52) U.S. Cl.
CPC ..... *E05B 9/084* (2013.01); *E05B 47/0004* (2013.01); *E05B 47/0012* (2013.01); *G07C 2009/00761* (2013.01); *G07C 2209/62* (2013.01)

(58) Field of Classification Search
CPC .. E05B 9/084; E05B 47/0004; E05B 47/0012; E05B 2047/0083; E05B 2047/0095; E05B 37/08; E05B 37/10; G07C 2009/00761; G07C 2209/62
See application file for complete search history.

(56) References Cited

U.S. PATENT DOCUMENTS 4,386,510 A 6/1983 Best
6,604,394 B2 8/2003 Davis
2006/0016230 A1* 1/2006 Loughlin ..... E05B 19/00 70/366
2006/0096343 A1* 5/2006 Loughlin ..... E05B 19/00 70/366
2008/0072637 A1* 3/2008 Padilla ..... E05B 9/086 70/371
2009/0280862 A1* 11/2009 Loughlin ..... E05B 29/00 455/556.1
2010/0194526 A1* 8/2010 Loughlin ..... E05B 37/08 340/5.2
2010/0194527 A1* 8/2010 Loughlin ..... E05B 37/08 340/5.6
2013/0014552 A1 1/2013 Bench
2016/0047142 A1* 2/2016 Gengler ..... G07C 9/00571 340/5.61
2016/0217637 A1* 7/2016 Gengler ..... G07C 9/00174
2017/0314293 A1* 11/2017 Scheffler ..... E05B 5/00

* cited by examiner

*Primary Examiner* — Orlando Bousono
(74) *Attorney, Agent, or Firm* — Phillips, Ryther & Winchester; Justin Flanagan

(57) ABSTRACT

A wireless, electronic interchangeable locking core that includes an outer housing and a locking core that is rotatable via an external handle between a locked position and an unlocked position. The handle is prevented from rotating the locking core unless wirelessly-provided authorization credentials are validated and/or a pattern of physical input interactions with an electronic sensor is matched with a stored pattern. The pattern may be defined, for example, as a sequence of short and long interactions with a button, light sensor, touch panel, or the like. The electronic interchangeable locking core may include a battery and be configured for installation in small format interchangeable core (SFIC) housings.

30 Claims, 18 Drawing Sheets

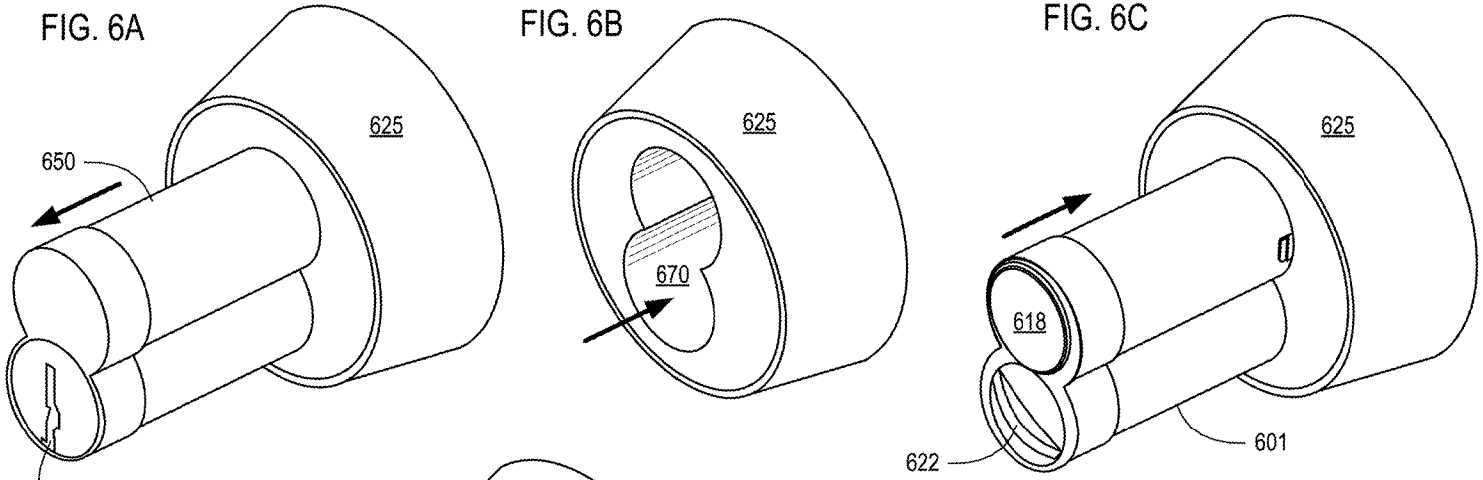
FIG. 6A
FIG. 6B
FIG. 6C
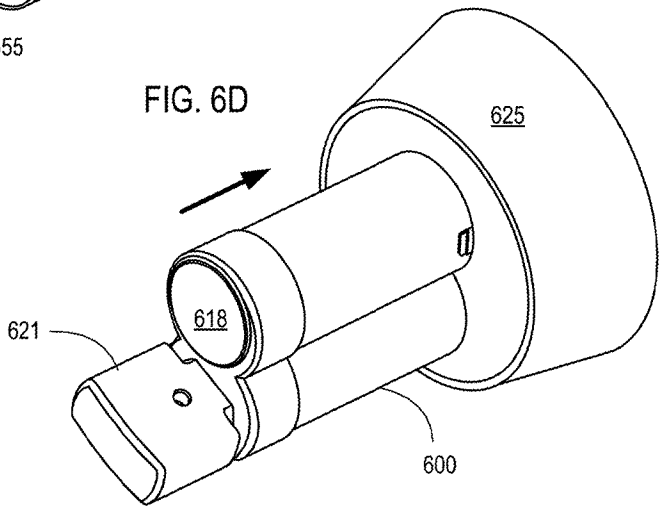
FIG. 6D
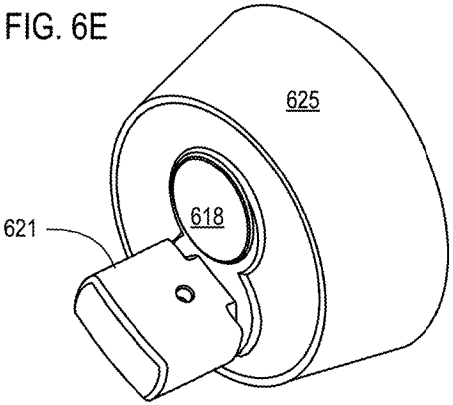
FIG. 6E

WIRELESS-ENABLED INTERCHANGEABLE LOCKING CORE

PRIORITY APPLICATIONS

None

TECHNICAL FIELD

This disclosure generally relates to systems and methods for interchangeable locking cores. Specifically, this disclosure relates to wireless-enabled interchangeable locking core cylinders that can replace existing, traditional key-operated locking core cylinders.

BRIEF DESCRIPTION OF THE DRAWINGS

Non-limiting and non-exhaustive embodiments of the disclosure are described herein, including various embodiments of the disclosure with reference to the figures listed below.

FIG. 6A illustrates a standard key-based SFIC locking core being removed from a lock assembly, according to one embodiment.

FIG. 6B illustrates an empty lock assembly configured to receive an SFIC locking core, according to one embodiment.

FIG. 6C illustrates one embodiment of a wireless-enabled SFIC locking core being inserted into the lock assembly.

FIG. 6D illustrates another embodiment of a wireless-enabled SFIC locking core being inserted into the lock assembly.

FIG. 6E illustrates the wireless-enabled SFIC locking core of FIG. 6D fully inserted into the lock assembly.

DETAILED DESCRIPTION

Figure 1:
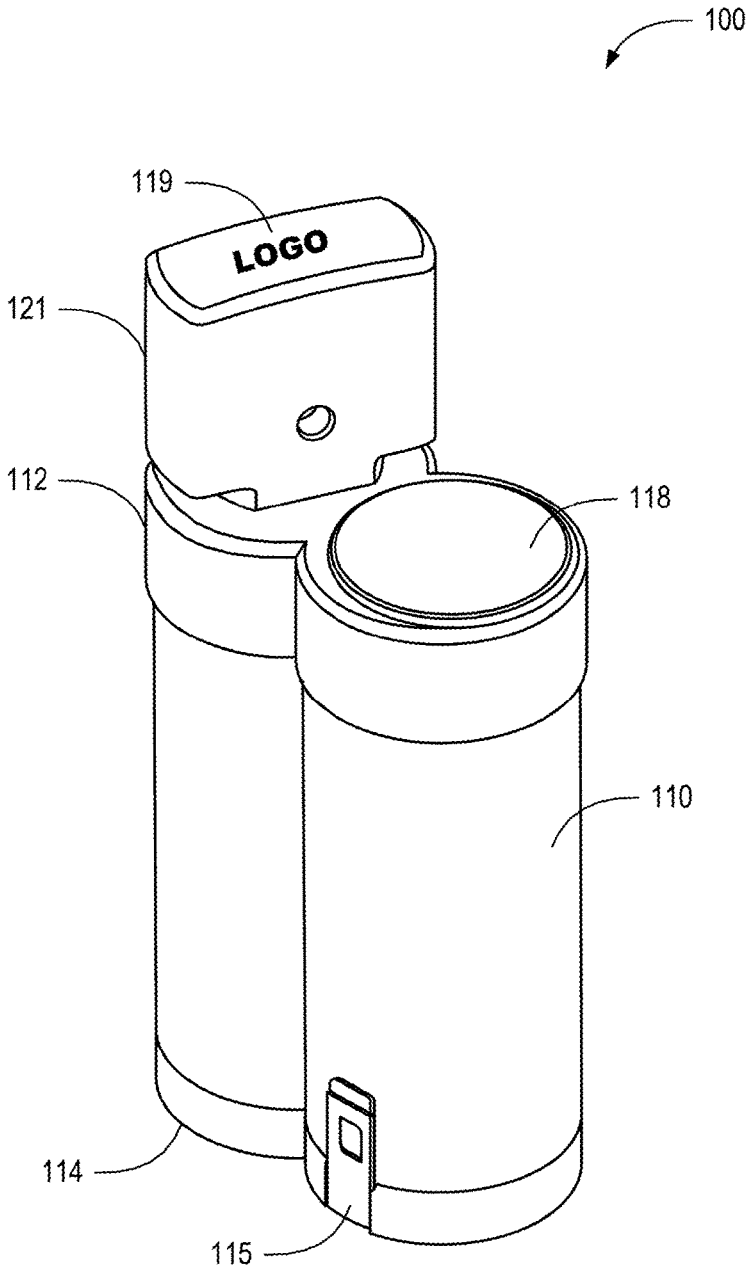
FIG. 1 illustrates a wireless-enabled interchangeable locking core compatible with the small format interchangeable core (SFIC) standard, according to one embodiment.

A wide variety of lock types and internal locking mechanisms have been developed over the years. Examples of lock technologies include mortise locks, padlocks, bored cylindrical locks, cylinder locks, warded locks, lever tumbler locks (e.g., 3 and 5 lever locks), Chubb detector locks, etc. Moreover, various adaptations of basic lock technologies and combinations thereof may be utilized.

Many types of locks, such as mortise locks, bored cylindrical locks, and padlocks have been adapted to include a core receptacle that accommodates interchangeable locking cores. Examples of interchangeable cores are the large format interchangeable core (LFIC/FSIC), rim cylinder housing with interchangeable cores, and mortise cylinder housing with interchangeable cores. Another example of an interchangeable core is the standardized small format interchangeable core (SFIC). The SFIC core standard specifies, among other things, a specific size and shape to fit within a core receptacle of an SFIC lock assembly. Other interchangeable locking cores may have different specifications to fit within core receptacles of generic or proprietary lock assembly configurations.

Interchangeable locking core standards, such as SFIC, may specify features for inserting, securing, and removing (e.g., for replacement) the locking core from the core receptacle of a lock assembly. Traditional locking cores include a keyhole to receive a key. Rotation of the key "unlocks" the lock by causing, for example, a deadbolt to retract. The wrong key cannot be turned within the locking core and therefore cannot be used to retract the deadbolt or actuate another locking mechanism. Basic principles of interchangeable locking cores, mechanical locking components, lock assemblies, and the like are well known in the art. Accordingly, many of the details regarding the same are omitted from this specification in the interest of clarity and brevity. Examples of such components are described in numerous patents, including U.S. Pat. No. 4,386,510 filed on Mar. 2, 1981, which application is hereby incorporated by reference in its entirety to the extent it is not inconsistent herewith.

Many interchangeable locking cores include a control tab that can be used to remove the interchangeable locking core from a core receptacle of a lock assembly. Because many of the embodiments of the presently described systems and methods do not utilize a standard physical key, an electronically actuated internal control tab may be used instead. For example, a control tab may be controlled via an application using master login credentials. An application interface of an owner or owners of the lock may include a "replace locking core" option that actuates an electronically controlled control tab. With the control tab internally engaged, the locking core can be removed from the core receptacle of a lock assembly by rotating a handle to a certain position and pulling the locking core free from the lock assembly.

This disclosure describes various embodiments of wireless-enabled interchangeable locking cores (sometimes referred to as simply "locks" or "locking cores"). Many of the embodiments described herein do not utilize a standard key (e.g., a metal key with ridges), but instead relay on a wireless or pattern-based authentication. In some embodiments, standard key may also be utilized as a backup. The wireless-enabled interchangeable locking core can, for example, be Bluetooth enabled such that proximity of an authorized user to the lock allows the lock to be unlocked and/or results in the lock automatically unlocking. Prior "electronic locks" with interchangeable cores, such as U.S. Pat. No. 6,604,394, have been electronic in the sense that they utilize a microprocessor to validate an electronic key. However, such "electronic locks still require a physical key, fob, card, or another dedicated electronic device that acts as the key. The presently described systems and methods allow for wireless operation using an existing portable electronic device that is Bluetooth enabled (e.g., a mobile phone, tablet, laptop, watch, wearable tech, smart glasses, etc.).

This application also describes various systems and methods that allow a user to unlock the lock by providing a pattern of inputs via an input device associated with the lock. For example, a pattern of long and short touch inputs can be used to actuate the lock (i.e., lock or unlock the locking mechanism). This application also describes various systems and methods for powering, jump-starting, and charging a wireless-enabled interchangeable locking core.

The following description includes specific details and examples in the context of the drawings. It is appreciated that the principles of this disclosure can be applied to a wide variety of locks, security systems, standardized locking systems, and proprietary locking system.

Some of the infrastructure that can be used with embodiments disclosed herein is already available, such as: general-purpose computers, computer programming tools and techniques, digital storage media, and communications networks. A computer may include a processor, such as a microprocessor, microcontroller, logic circuitry, or the like. The processor may include a special-purpose processing device, such as an ASIC, a PAL, a PLA, a PLD, a CPLD, a Field Programmable Gate Array (FPGA), or other customized or programmable device. The computer may also include a computer-readable storage device, such as non-volatile memory, static RAM, dynamic RAM, ROM, CD-ROM, disk, tape, magnetic memory, optical memory, flash memory, or another computer-readable storage medium.

Suitable networks for configuration and/or use, as described herein, include any of a wide variety of network infrastructures. Specifically, a network may incorporate landlines, wireless communication, optical connections, various modulators, demodulators, small form-factor pluggable (SFP) transceivers, routers, hubs, switches, and/or other networking equipment. Networks and wireless communication generally encompass a wide range of electromagnetic radiation communications frequency bands, modulation protocols, encoding, encrypting, communication protocols and hardware protocols.

Examples of suitable protocols and technologies include, but are not limited to, 802.xx protocols (e.g., Wi-Fi), Bluetooth protocols, near-field communication (NFC) protocols, radio frequency identification (RFID) protocols, ZigBee, Z-wave, BACnet, 6LoWPAN, RPL, CoAP, cellular protocols (e.g., 4G LTE), Thread, Sigfox, Neul, LoRaWAN, and/or various protocols using the ISM bands in the U.S., SRD bands in Europe, and the like in other jurisdictions.

Related networks may also include communications or networking software, such as software available from Novell, Microsoft, Artisoft, and other vendors, and may operate using TCP/IP, SPX, IPX, SONET, and other protocols over twisted pair, coaxial, or optical fiber cables, telephone lines, satellites, microwave relays, modulated AC power lines, physical media transfer, wireless radio links, and/or other data transmission "wires." The network may encompass smaller networks and/or be connectable to other networks through a gateway or similar mechanism. In some embodiments, virtual networks and software-defined networks may be utilized.

Aspects of certain embodiments described herein may be implemented as software modules or components. As used herein, a software module or component may include any type of computer instruction or computer-executable code located within or on a computer-readable storage medium, such as a non-transitory computer-readable medium. A software module may, for instance, include one or more physical or logical blocks of computer instructions, which may be organized as a routine, program, object, component, data structure, etc., that perform one or more tasks or implement particular data types, algorithms, and/or methods.

Various compatible embodiments, data structures, systems, network configurations, and functionalities of wireless-enabled locks can be adapted for use with the various embodiments of locking cores described herein, including without limitation and to the extent consistent herewith, the embodiments described in U.S. patent application Ser. No. 15/009,640 filed on Jan. 28, 2016, titled "Electronic Padlocks and Related Methods," which application is hereby incorporated by reference in its entirety.

A particular software module may comprise disparate instructions stored in different locations of a computer-readable storage medium, which together implement the described functionality of the module. Indeed, a module may comprise a single instruction or many instructions and may be distributed over several different code segments, among different programs, and across several computer-readable storage media. Some embodiments may be practiced in a distributed computing environment where tasks are performed by a remote processing device linked through a communications network. In a distributed computing environment, software modules may be located in local and/or remote computer-readable storage media. In addition, data being tied or rendered together in a database record may be resident in the same computer-readable storage medium, or across several computer-readable storage media, and may be linked together in fields of a record in a database across a network.

Some of the embodiments of the disclosure can be understood by reference to the drawings, wherein like parts are designated by like numerals throughout. The components of the disclosed embodiments, as generally described and illustrated in the figures herein, could be arranged and designed in a wide variety of different configurations. Further, those of skill in the art will recognize that one or more of the specific details may be omitted, or other methods, components, or materials may be used. In some cases, operations are not shown or described in detail. Thus, the following detailed description of the embodiments of the systems and methods of the disclosure is not intended to limit the scope of the disclosure, as claimed, but is merely representative of possible embodiments.

FIG. 1 illustrates a wireless-enabled interchangeable locking core 100 compatible with the small format interchangeable core (SFIC) standard, according to one embodiment. Internal components of the wireless-enabled interchangeable locking core 100 are contained within outer housing 110 along with a front cover 112 and a rear cover 114. One or more latches 115 may connect the rear cover 114 to the outer housing 110. In various embodiments, two or more components described herein as distinct components may be combined as a single component. For example, one or more of housing 110, front cover 112, and rear cover 114 may be combined as a single casing component. Similarly, many of the components described herein may be separated into a plurality of sub-components while retaining similar or identical functionality. Combining some components may allow for the omission of other components. For example, in an embodiment in which the outer housing 110 and the rear cover 114 are formed as a single component, latches 115 may be omitted.

In some embodiments, a relatively large handle 121 may extend from the front cover 112 of the wireless-enabled interchangeable locking core 100. In other embodiments, the handle 121 may be reduced in size and/or have any of a wide variety of shapes and sizes. The handle, regardless of shape, size, configuration, is externally accessible to an operator to allow the operator to rotate an inner lock core when the locking core is in a released state. The inner lock core may not be rotated by the handle 121 when the lock core is in a secured or locked state.

As used herein in the context of the locking core, the phrase "released state" refers to the state of the locking core with respect to an associated locking mechanism (e.g., a deadbolt). Specifically, with the locking core in a released state, the locking core is both engaged with the locking mechanism and a lock core is allowed to rotate. Thus, with the locking core in the releases state, the handle may be used to rotate the lock core that is mechanically coupled to the locking mechanism in such a manner to cause the locking mechanism to be unlocked.

As used herein in the context of the locking core, the phrase "secured state" refers to the state of the lock core with respect to the locking mechanism as being mechanically disengaged from the locking mechanism, the handle being mechanically disengaged from the lock core, the handle being prevented from rotating, and/or the lock core being prevented from rotating. Regardless of which approach is used, the locking core is described as being in the secured state since the handle cannot be used to unlock the locking mechanism. Thus, transitioning the locking core from the secured state to the released state may include one or more of engaging the lock core with a locking mechanism, allowing the lock core to be rotated, allowing the handle to be rotated, and/or engaging the handle with the lock core.

The handle 121 may be connected to a shaft of a motor holder (not visible in FIG. 1). A logo, instructional marking, or identifier may be located on a button cap 118, front cover 112, and/or the handle 121. A logo 119 is illustrated on one face of the handle 121.

In various embodiments, the handle 121 may rotate (e.g., be rotated by an operator or an electric motor) when locking or unlocking. The button cap 118 may be used as a button to turn on the lock, turn off the lock, and/or as an input device for providing a touch pattern (quick-click pattern) to actuate the lock. In some embodiments, the button cap 118 activates a power source for a predetermined amount of time. Once activated, the wireless-enabled interchangeable locking core 100 may "listen" for wireless singles to actuate a motor within the lock (e.g., a stepper motor or a DC motor) and/or "listen" for a quick-click input for similar functionality.

To conserve power, the lock may remain in a low-power or even a no-power state (referred to herein as an "idle state") until activated (e.g., by pushing the button cap 118). In some embodiments, the lock may instead or additionally be activated based on a received signal (e.g., RFID, NFC, Bluetooth, etc.). The signal may induce sufficient current in, for example, a coil to provide a "wake up" signal to activate the lock and cause it to listen for an actuation signal. In some embodiments, the lock may remain in a low-power state to listen for actuation signals, and thus not require the button cap 118 for activation. In some embodiments, the functionality of the button cap (according to any of the embodiments described herein) 118 may be integrated into the handle 121. When a locking core "wakes up" it may transmit a lower power beacon and an authorized Bluetooth mobile device may respond by providing authentication credentials.

In some embodiments, button cap 118 may be used to actuate the lock. That is, the button cap 118 may be pushed to lock and/or unlock the lock. It is appreciated that the functionality of a button can be replaced with any of a wide variety of technologies, including switches, toggles, capacitive touch inputs, resistive touch inputs, light sensors, motions sensors, accelerometers, slide contacts, and the like.

Figure 2:
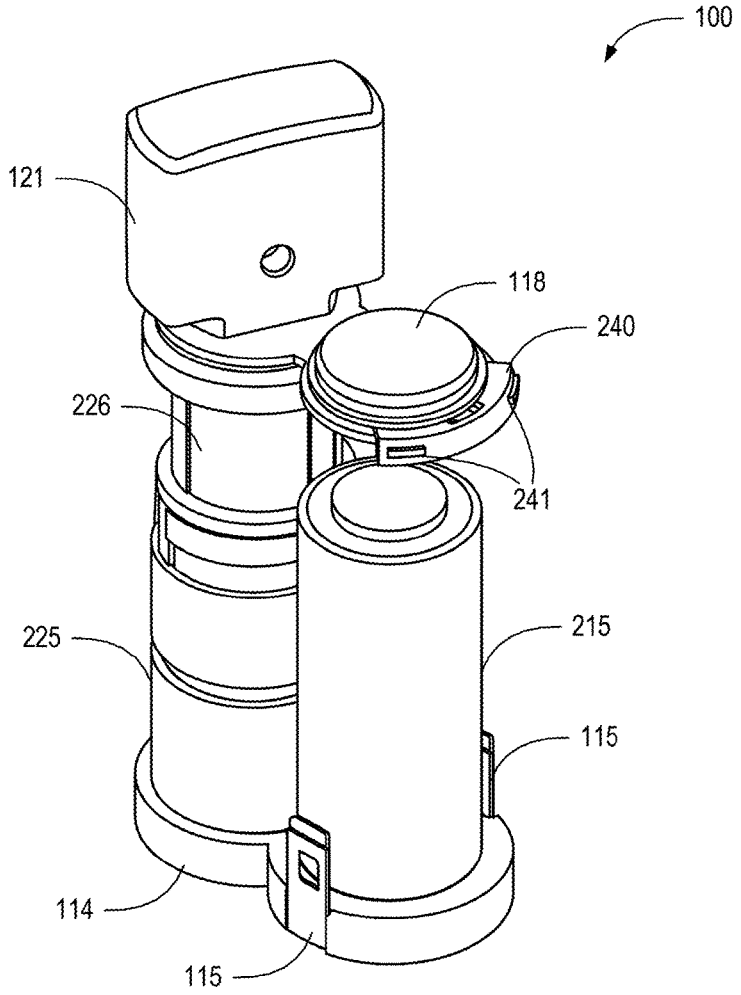
FIG. 2 illustrates the wireless-enabled interchangeable locking core of FIG. 1 with the outer housing and cover removed, according to one embodiment.

FIG. 2 illustrates the wireless-enabled interchangeable locking core 100 of FIG. 1 with the outer housing 110 and the housing cover 112 removed. As illustrated, internal components of the wireless-enabled interchangeable locking core 100 may include a power supply 215 and a lock core 225. A motor holder 226 may have a shaft (not shown) to which the handle 121 is connected. Status lights 241 may be part of a lighting system 240 to provide status indications.

The power supply 215 may be a battery that can be recharged and/or replaced when it loses charge. Alternatively, a supercapacitor may be used. In some embodiments, the power supply 215 (shown as a single cylinder) may include a battery and/or capacitor along with charging components. For example, in one embodiment, contacts may extend from charging components of the power supply 215 to an external port. In one embodiment, a charging port is located underneath the button cap 118. In another embodiment, a charging port extends through the button cap 118. In still other embodiments, a charging port is positioned proximate the button cap and the lighting system 240.

In some embodiments, no port is available, but two prongs are provided to allow a chip or disk battery (e.g., CR2032) to be used to "jump-start" the interchangeable locking core. The jump-start prongs may be positioned proximate the handle, on the handle, proximate the button cap 118, or under the button cap 118.

In one embodiment, the power supply 215 includes a wireless charging interface (e.g., via inductive charging or an RF-to-DC converter) that allows for a battery or capacitor to be wireless charged. In still other embodiments, the button cap 118, lighting assembly 240 and/or other components may be removed without unlocking the lock to allow for a battery to be replaced. In one embodiment, the lock provides a warning that a battery is low and replacement of the battery is only possible by unlocking the lock using the remaining charge in the nearly depleted battery.

Figure 3:
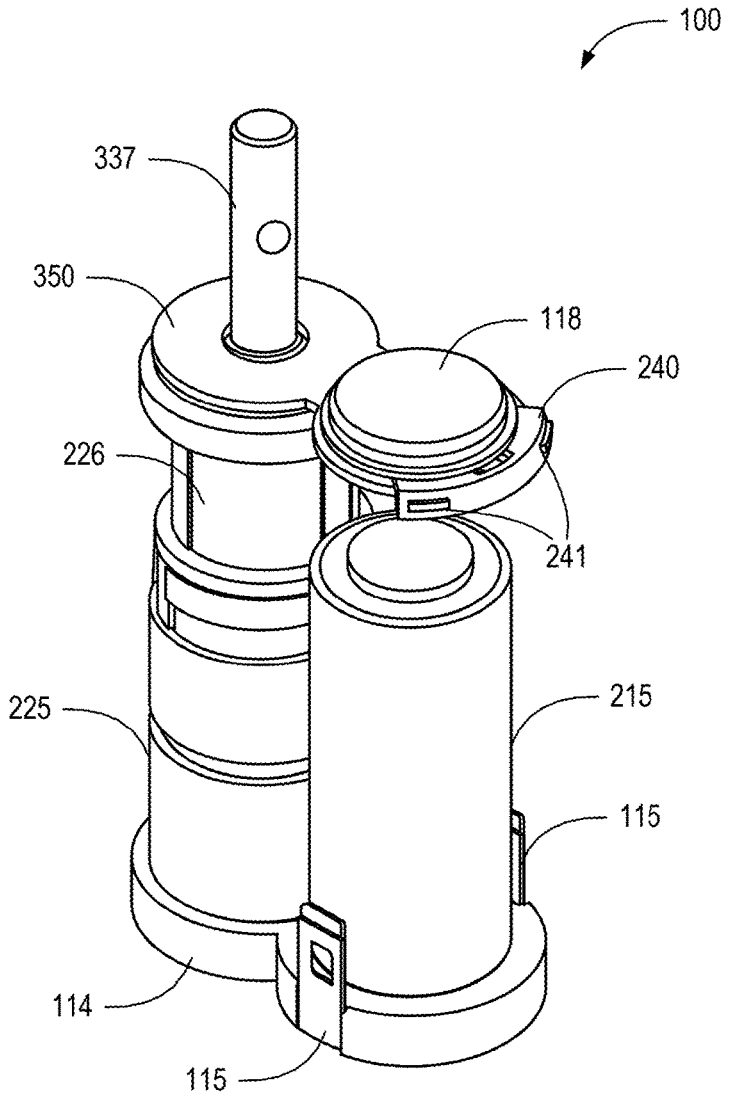
FIG. 3 illustrates the wireless-enabled interchangeable locking core of FIG. 2 with the handle removed to expose the motor shaft, according to one embodiment.

FIG. 3 illustrates the wireless-enabled interchangeable locking core 100 of FIG. 2 with the handle 121 removed to expose the motor shaft 337 of the motor holder 226, according to one embodiment. The shaft 337 and/or the handle 121 may have apertures to accommodate fasteners, groves, protrusions, and/or the like to facilitate rotationally couple the shaft 337 to the handle 121. A control printed circuit board (PCB) 350 may have an aperture for the shaft 337 to pass through. In alternative embodiments, the control PCB 350 may be formed as a split ring to allow the shaft 337 to pass through the split. In still other embodiments, the control PCB 350 may be formed smaller and/or not positioned proximate or around the shaft 337. A spacer PCB 552 (FIG. 5) may separate the control PCB 350 from the top surface of the motor holder 226. Spring contacts 551 (FIG. 5) may facilitate electrical connections from the control PCB 350.

The control PCB 350 may include a processor, microprocessor, field-programmable gate array (FPGA), and/or various hardware circuitry. For example, the control PCB may include a custom application specific integrated circuit (ASIC), memory, and/or various input terminals and output terminals. As discussed above, the control PCB 350 may remain in an idle state (e.g., low-power or no-power state) until the lock is activated (e.g., via button cap 118). The control PCB 350 may be configured to receive a Bluetooth signal (or another wireless signal such as NFC, RFID, etc.). The Bluetooth signal may be encrypted and/or include an instruction to unlock the lock and/or allow the lock to be unlocked.

Thus, the PCB 350 may be described as an electronic controller that includes a wireless receiver (e.g., a Bluetooth module, NFC module, etc.) an input detector, an authorization controller, a locking state controller, a memory, processing abilities, communication modules, and/or various hardware circuitry. In various embodiments, the PCB 350 may compare, via an authorization controller, authorization credentials received via a wireless receiver, with authorization credentials stored in a memory. Such authorization credentials may be in the form of exact-match data, cryptographic hashes, public/private keys, encrypted communications, and commands, and/or the like.

In some embodiments, the PCB 350 may not have or utilize memory and processing power to validate authorization credentials. Rather, the authorization controller may include a communication module to confirm with a remote processor (e.g., a cloud service) that the received authorization credentials are valid.

The PCB 350 may include an input detector to confirm that a received pattern of physical input interactions matches a sequence stored in local memory and/or in a cloud-based memory. The PCB 350 may then utilize locking state controller to transition the locking core from the secured state to the released state. For example, upon validation of either the authorization credentials or the input pattern of interactions with the electronic sensor, a motor, such as a stepper motor or a DC motor, may rotate to transition the locking core to the released state.

One or more of the locking state controller, authorization controller, input detector, wireless receiver, idle/active state controller, memory, processors, and/or other electronic components may be combined as a single component or as a set of connected components that share one or more resources (referred to generally as an electronic controller).

In some embodiments, the lock may have been previously paired with a Bluetooth-enabled mobile device. When the paired Bluetooth-enabled mobile device is within range of the lock, the paired Bluetooth-enabled mobile device may transmit an unlock signal. Once the lock is activated (if it is in an idle state), it will receive the unlock signal from the paired Bluetooth-enabled mobile device. In some embodiments, a lock may be pre-paired or not requiring conventional pairing with a Bluetooth-enabled mobile device. For examples, one or more keycards or fobs (also known as key fobs) may be utilized with wireless-enabled locking core that do not require pairing.

The handle 112 may then be used to rotate the shaft 337 and unlock the lock. Absent an unlock signal, a stepper motor (or another motor) of the lock may not be actuated and the handle 112 may be prevented from rotating the shaft 337. Similar functionality may be adapted for devices and locks utilizing NFC, RFID, 6LoWPAN, ZigBee, etc. Status lights 241 in the lighting system 240 may provide feedback regarding the status of the lock. For example, a red light may be displayed when a lock cannot be actuated. A green light may be displayed when a lock has successfully received an unlock signal to cause the stepper motor to rotate. Combinations of colors, flashing patterns, and the like may be used to indicate a pairing mode, actuation, failed actuations, battery status, and/or the like.

Figure 4:
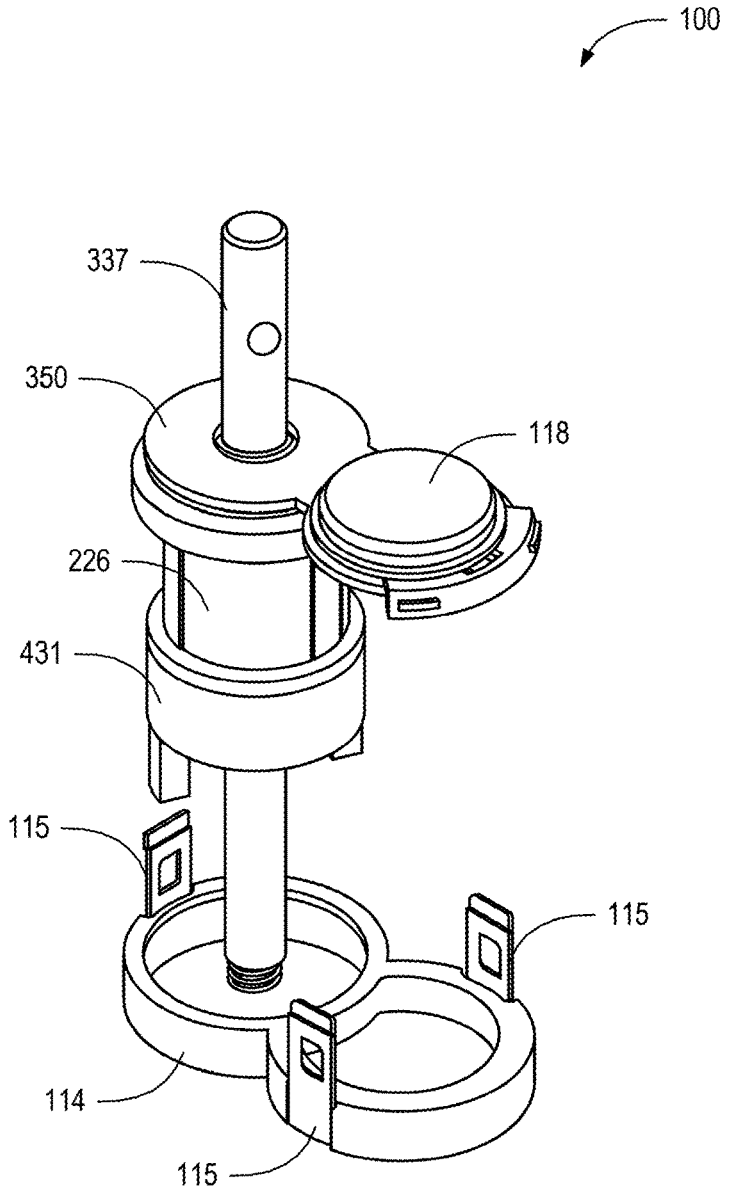
FIG. 4 illustrates the wireless-enabled interchangeable locking core of FIG. 3 with the power supply removed, according to one embodiment.
Figure 5:
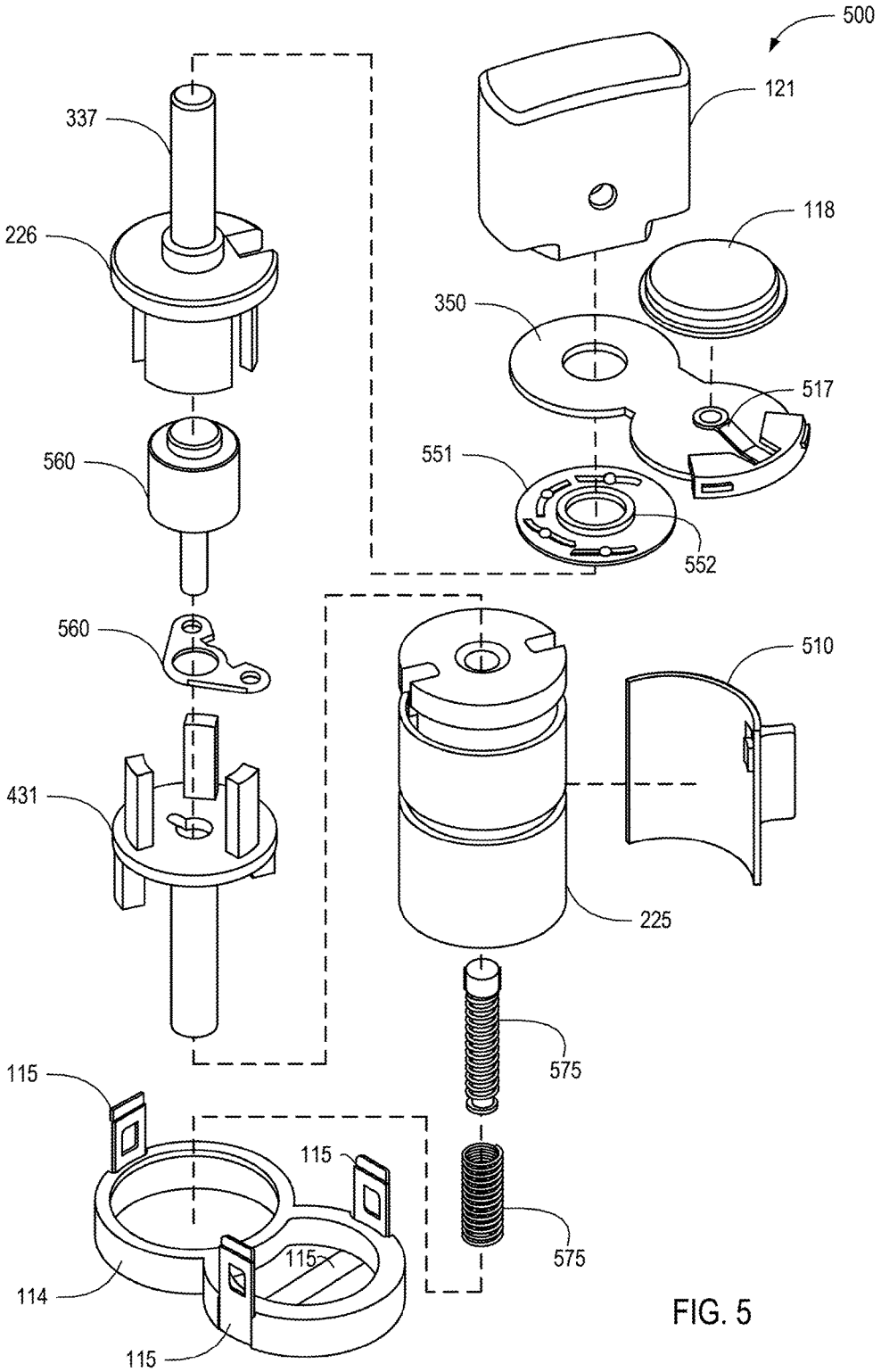
FIG. 5 illustrates an exploded view of various components of a wireless-enabled interchangeable locking core, according to various embodiments.

FIG. 4 illustrates the wireless-enabled interchangeable locking core 100 of FIG. 3 with the power supply 215 and the lock core 225 removed, according to one embodiment. n FIG. 4, the three latches 115 are shown as independent latches. In contrast, two of the latches 115 in FIG. 5 are shown connected with a rear cover support. With the lock core 225 removed, the key 431 with interlock arms extending up into the motor holder 226 and down into the lock core 225. Moreover, three latches 115 are shown that secure the rear cover 114 to the outer housing 110.

Multiple elements that are standard or commonly employed in electrical and mechanical designs are not illustrated to avoid confusion. For example, battery contacts (e.g., wires or metal strips) to connect the battery to the control PCB 350 are not illustrated. Similarly, various spacers, insulators, contacts, and springs are not illustrated to more clearly illustrate the other components of the wireless-enabled interchangeable locking core 100.

FIG. 5 illustrates an exploded view 500 of various components of a wireless-enabled interchangeable locking core, according to various embodiments. A rear cover 114 may be secured to an outer housing (not shown) via one or more latches 115. A lock core 225 may fit within the rear housing. A control tab 510 may be positioned around a portion of the lock core 225. In some embodiments, the control tab 510 may be biased by a leaf spring (not shown). The control tab 510 allows the wireless-enabled interchangeable locking core to be removed from a core receptacle of a lock assembly.

In various embodiments, the control tab 510 may be controlled via an application using master login credentials. For example, an application interface may include a "replace locking core" option that engages the control tab 510. With the control tab 510 engaged, the locking core can be removed from a lock assembly. For instances, once the control tab 510 is engaged the handle 121 may be rotated a preset amount (e.g., 15 degrees). The handle 121 may then be grasped and used to pull the wireless-enabled interchangeable locking core out of the core receptacle of a lock assembly.

A lower shaft of the key 431 may be inserted into the lock core 225 and accommodate a first compression spring 574 and a return compression spring 575. In some embodiments, the springs 574 and 575 may facilitate the selective engagement of the locking core 225 with a rear-engagement pins of a lock assembly (e.g., rear engagement pins 707 in FIG. 7A). For example, the springs 574 and 575 may bias the lock core to disengage the lock core 225 from the lock assembly until a user is authenticated.

The shaft of a stepper motor 560 may pass through a mount 560. The stepper motor 560 may sit within upward-extending interlock arms of the key 431. The downward-extending interlock arms of the motor holder 226 may interface with the upward-extending interlock arms of the key 431.

Spring contacts 551 may be positioned on a plate (as illustrated) or may be formed directly on the upper surface of the motor holder 226 to obviate the need for the plate. Though not illustrated, the motor holder 226 may include one or more apertures or thru-bores to facilitate electrical connections from the control PCB 350, via the spring contacts 551, to other components of the wireless-enabled interchangeable locking core 100. In the illustrated embodiment, the control PCB 350 has an aperture through which the shaft 337 of the motor mount 226 passes. A button contact 517 may provide an electrical contact between the button cap 118 and the control PCB 350. Finally, the handle 121 may be secured to the shaft 337.

FIG. 6A illustrates a standard key-based SFIC locking core 650 being removed from a core receptacle of a lock assembly 625, according to one embodiment. The standard key-based SFIC locking core 650 includes a keyhole 655 to receive a standard metal key. In some embodiments, an "electronic" SFIC locking core 650 may read a microchip on an inserted key to confirm that the key is the correct key. However, the standard key-based SFIC locking core 650, whether electronic or not, does not allow for quick-click actuation or wireless actuation based on signals from, for example, a Bluetooth mobile device such as a mobile phone.

FIG. 6B illustrates an empty core receptacle 670 of the lock assembly 625 configured to receive an SFIC locking core via an aperture, according to one embodiment.

FIG. 6C illustrates one embodiment of a wireless-enabled SFIC locking core 601 partially inserted into the core receptacle of the lock assembly 625. The wireless-enabled SFIC locking core 601 includes a button cap 618 as well as an unobtrusive handle 622.

FIG. 6D illustrates another embodiment of a wireless-enabled SFIC locking core 600 partially inserted into the core receptacle of the lock assembly. The wireless-enabled SFIC locking core 600 includes a handle 621, similar to the handle 121 described in conjunction with FIGS. 1-5 above, and a button cap 618, similar to the button cap 118 described in conjunction with FIGS. 1-5.

FIG. 6E illustrates the wireless-enabled SFIC locking core 600 of FIG. 6D fully inserted into the lock assembly 625.

Figure 7B:
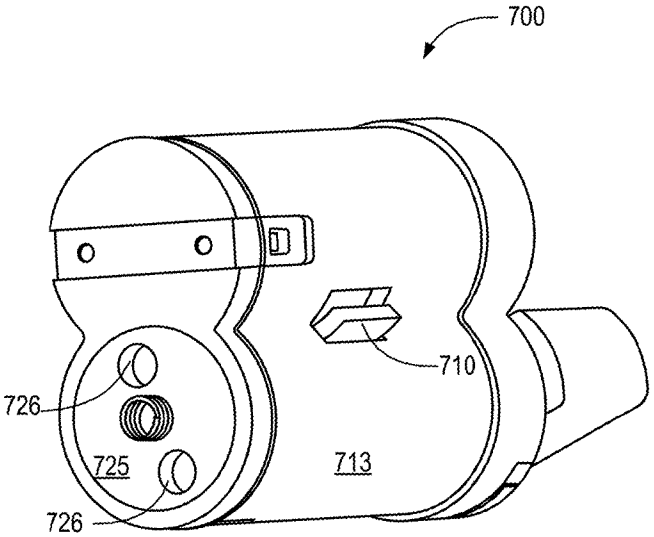
FIG. 7B illustrates another view of a wireless-enabled SFIC locking core illustrating two holes in the lock core to engage with the rear engagement pins.
Figure 7A:
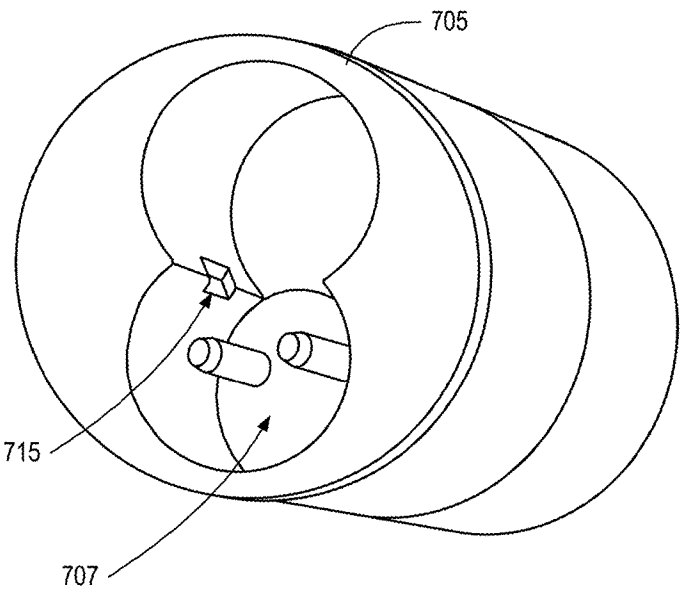
FIG. 7A illustrates another view of a lock assembly showing rear engagement pins and a core-lock groove, according to one embodiment.

FIG. 7A illustrates another view of a lock assembly 705 showing rear engagement pins 707 and a core-lock groove 715, according to one embodiment. According to various embodiments, rear engagement pins 707 may be a wide variety of alternative shapes and sizes and the engagement portion of the locking core (e.g., the two holes 726 in FIG. 7B) may be adapted accordingly. The core-lock groove 715 or slot may facilitate securing and releasing the wireless-enabled SFIC locking core.

FIG. 7B illustrates a view of the wireless-enabled SFIC locking core 700 with two holes 726 in the lock core 725 to engage with the rear engagement pins 707 of the lock assembly 705. As illustrated, the control tab 710 extends through the outer housing 713. An administrator or user with removal privileges may send a control signal to the wireless-enabled SFIC locking core 700 with an instruction to enter a removal mode. In the removal mode, a motor in the wireless-enabled locking core 700 causes the control tab 710 to rotate until it is flush with the outer housing. With the control tab 710 flush with the outer housing, a user can remove the wireless-enabled SFIC locking core 700 from the lock assembly 705.

Figure 8B:
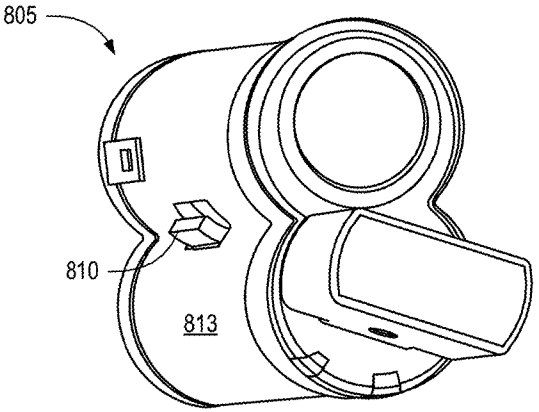
FIG. 8B illustrates the wireless-enabled SFIC locking core with the control tab rotated to a secured state.
Figure 8C:
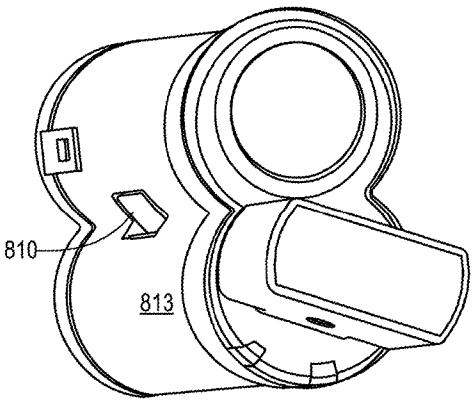
FIG. 8C illustrates the wireless-enabled SFIC locking core with the control tab rotated to a release state to allow the SFIC locking core to be inserted or removed from the lock assembly.
Figure 8A:
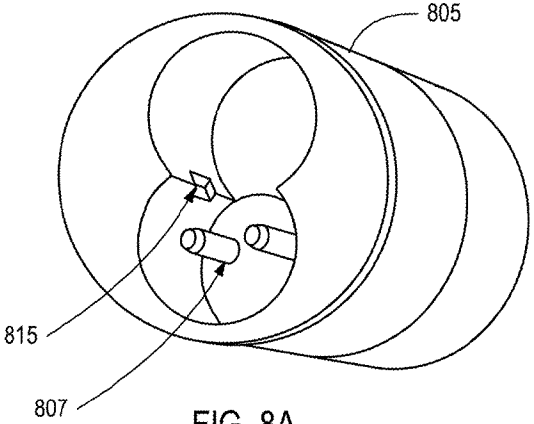
FIG. 8A illustrates the lock assembly with the rear engagement pins and the core-lock groove.

FIG. 8A illustrates the lock assembly 805 with the rear engagement pins 807 and the core-lock groove 815.

FIG. 8B illustrates the wireless-enabled SFIC locking core 800 with the control tab 810 rotated to a secured (extended) state. In the secured state, the control tab 810 protrudes from the outer housing 813. In some embodiments, the control tab 810 is biased to the secured or extended state. With the wireless-enabled SFIC locking core 800 inserted within the lock assembly 805, the control tab 810 is biased or rotated to the secured or extended state. In the secured or extended state, the control tab 810 enters the core-lock groove 815 and thereby secures the wireless-enabled SFIC locking core 800 within the lock assembly 805.

To insert the wireless-enabled SFIC locking core 800 into a lock assembly 805, a user may manually push the control tab 810 flush with the outer housing 813. Alternatively, the administrator or user with removal privileges may cause the wireless-enabled SFIC locking core 800 to enter a removal mode (in which the control tab 810 is moved or held in a rotated position flush with the outer housing 813) and then insert the wireless-enabled SFIC locking core 800 into the lock assembly 805.

FIG. 8C illustrates the wireless-enabled SFIC locking core 800 with the control tab 810 rotated flush with the outer housing 813 in the removal mode to allow a user to remove the wireless-enabled SFIC locking core 800 from the lock assembly 805. As described above, a user may also utilize the removal mode to insert the wireless-enabled SFIC locking core 800 into the lock assembly 805.

Figure 9A:
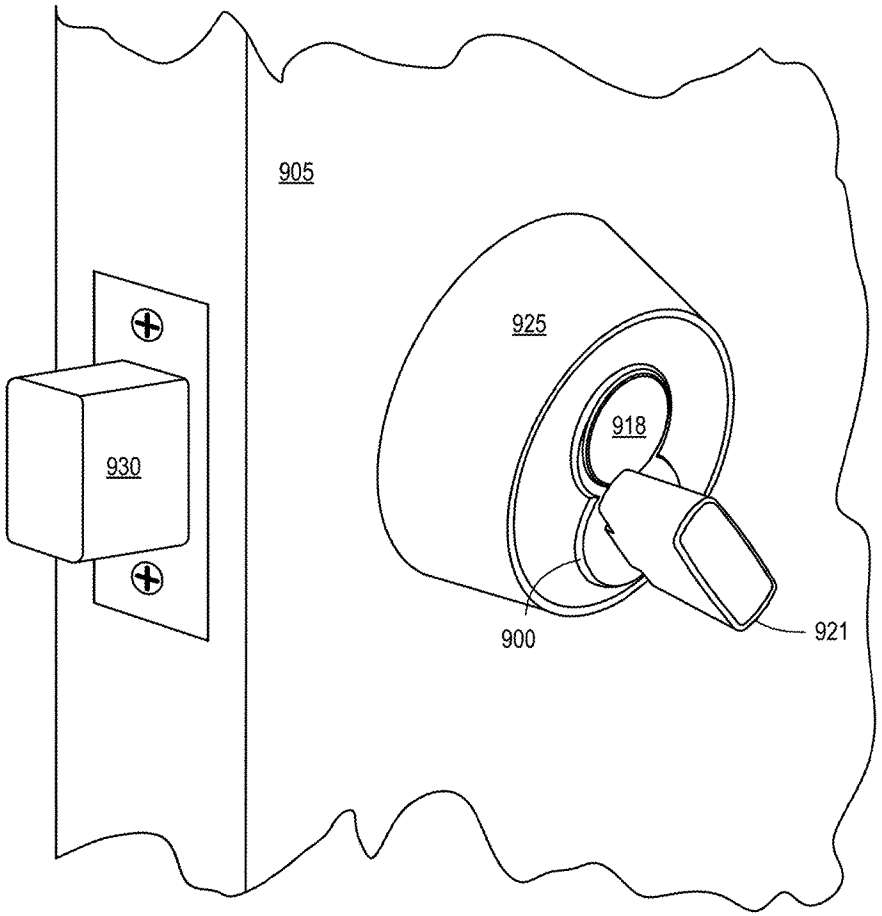
FIG. 9A illustrates an example of a wireless-enabled SFIC locking core inserted within a lock assembly installed on a door to control a standard deadbolt lock, according to one embodiment.

FIG. 9A illustrates an example of a wireless-enabled SFIC locking core 900 inserted within a lock assembly 925 installed on a door 905 to control a standard deadbolt locking mechanism 930, according to one embodiment. The wireless-enabled SFIC locking core 900 includes a handle 921 and a button cap 918, as described herein. The deadbolt locking mechanism 930 is shown in a locked position and would normally be entered into a strike plate or strike box on a jamb of a door.

Figure 9B:
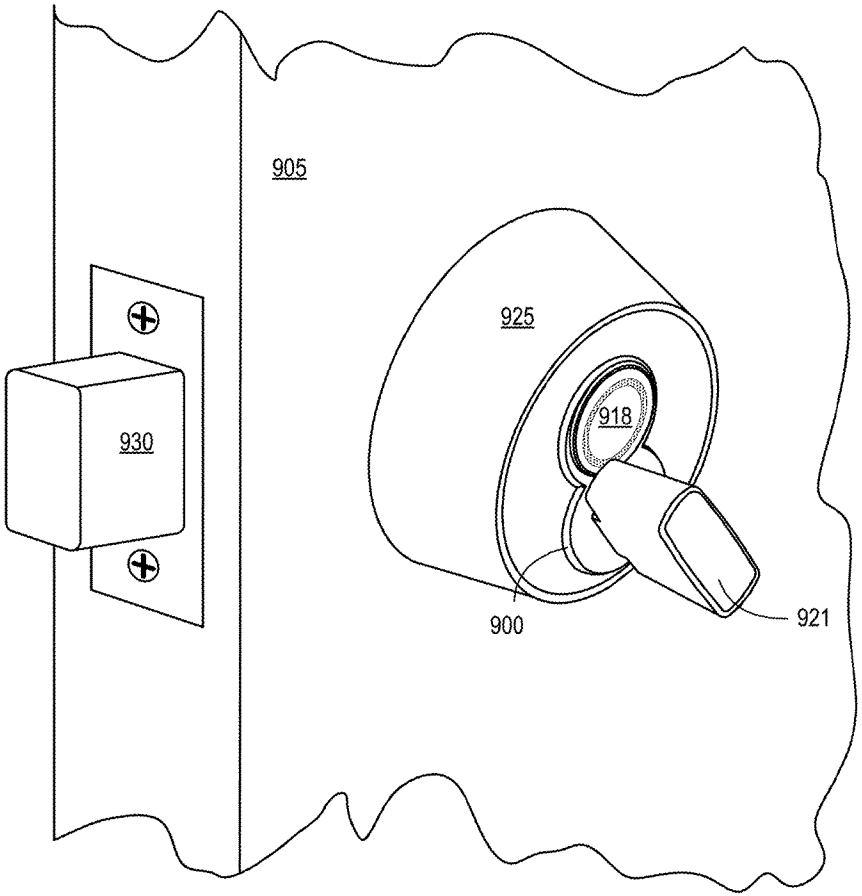
FIG. 9B illustrates the wireless-enabled SFIC locking core activated via the button cap, according to one embodiment.

FIG. 9B illustrates the wireless-enabled SFIC locking core 900 positioned within the lock assembly 925 of the door 905. The button cap 918 has been pressed to activate the lock, as indicated by a ring of lights (e.g., an activity light). Once activated, quick-click inputs (as described herein) or a signal from a wireless device may be authenticated by the wireless-enabled SFIC locking core 900 to allow the deadbolt 930 to be operated via handle 921.

In some embodiments, the quick-click inputs may be provided via the button cap 918. For instance, a pattern of long and short button pushes may be stored within a memory of the wireless-enabled SFIC locking core 900. A user may authenticate the lock by inputting the corresponding pattern of long and short button pushes via button cap 918. As another example, the pattern of quick-click inputs may comprise touches of varying intensity made via a button or touch sensitive input device. For instance, a pattern of hard presses and soft presses may be used to authenticate the lock.

As previously described, button cap 918 may be a physical button, virtual button, a switch, a toggle, touch-enabled (e.g., resistive or capacitive), motion sensor, light sensor, or the like. In such embodiments, combinations of long and short "inputs" may vary based on the type of sensor used. In some embodiments, a capacitive or resistive connection may be made with a portion of the door 905, the lock assembly 925, the handle 921, and/or a separate input panel. In such embodiments, the wireless-enabled SFIC locking core 900 may be activated by any one or a touch on the door 905, lock assembly 925, handle 921, or separate input panel connected via a wire.

Moreover, in such embodiments, a quick-click input may be provided via "quick-clicks" entered via touches on the door 905, touches on the lock assembly 925, touches on the handle 921, or touches via a separate input panel that is wirelessly connected or hardwired to the wireless-enabled SFIC locking core 900. As a specific example, the wireless-enabled SFIC locking core 900 may be activated by pushing the button cap 918. A quick-click input of patterns may then be entered by waving a hand in front of a remotely located light sensor for a pattern of short and long durations. The quick-click pattern of short and long light sensor inputs may be wirelessly transmitted to the wireless-enabled SFIC locking core 900 for authentication. If authentication fails, the lock cannot be unlocked and a light or a sound (e.g., via a speaker built into the lock or remote panel) may provide an indication of the same. If authentication is confirmed, a sound or light may provide an indication that the lock can be unlocked. A user may rotate the handle 921 to unlock the deadbolt 930.

Figure 9C:
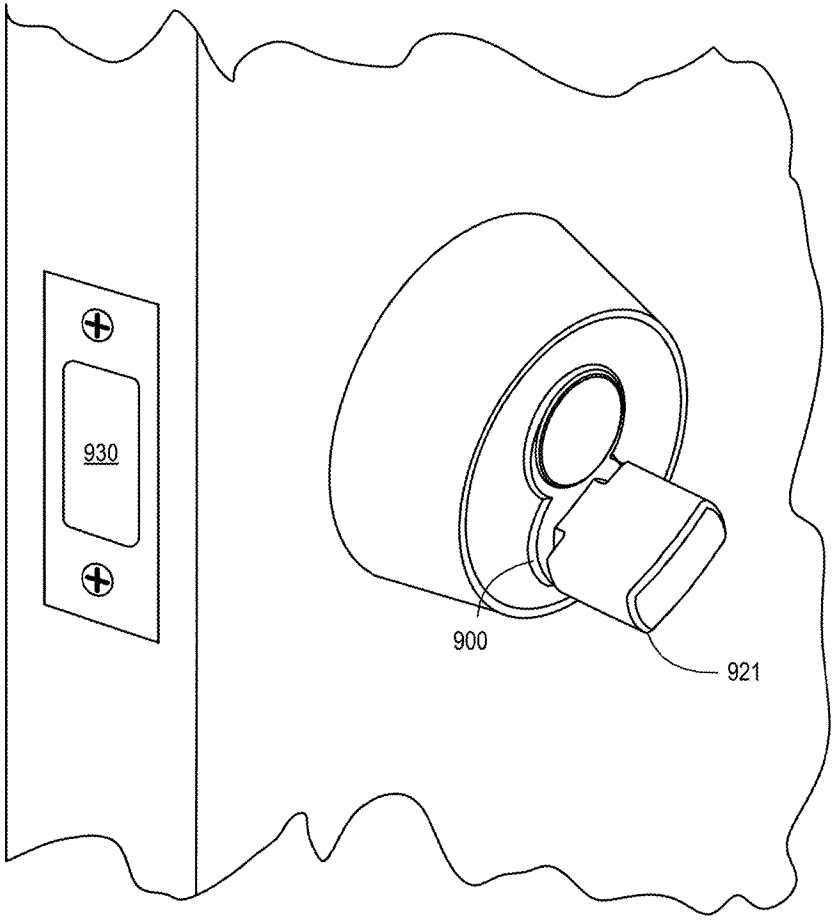
FIG. 9C illustrates a deadbolt having been unlocked by rotating the handle following authentication by the wireless-enabled SFIC locking core via either a quick-click input or a wireless signal, according to one embodiment.

FIG. 9C illustrates the deadbolt 930 having been unlocked by rotating the handle 921 following authentication by the wireless-enabled SFIC locking core 900 via either a quick-click input or a wireless signal from a wireless device, such as a Bluetooth-enabled mobile phone, according to one embodiment. In various embodiments, the wireless-enabled SFIC locking core 900 may go into a sleep state after being unlocked and/or after a predetermined time period to preserve power. In some embodiments, the mobile device used to authenticate the wireless-enabled SFIC locking core 900 may be configured to provide wireless power to a power supply of the wireless-enabled SFIC locking core 900.

In one embodiment, the wireless-enabled SFIC locking core 900 may be powered via wires within the door. In still other embodiments, the wireless-enabled SFIC locking core 900 may be charged via the deadbolt when the deadbolt is in a locked position via contacts within a strike box in a jamb of the door. In other embodiments, the wireless-enabled SFIC locking core 900 may be powered via internal replaceable or rechargeable batteries, as described in conjunction with FIGS. 1-5. In one embodiment, the rotational motion of unlocking and unlocking a locking mechanism via the handle 921 may be used to recharge a battery. In another embodiment, a button or other mechanically actuated component may be repeatedly actuated to recharge a battery. In such embodiments, the actuation of the button or another mechanically actuated component may induce an electric current in a coil of wire (e.g., by rotating or moving a magnet within a coil of wire).

Figure 10:
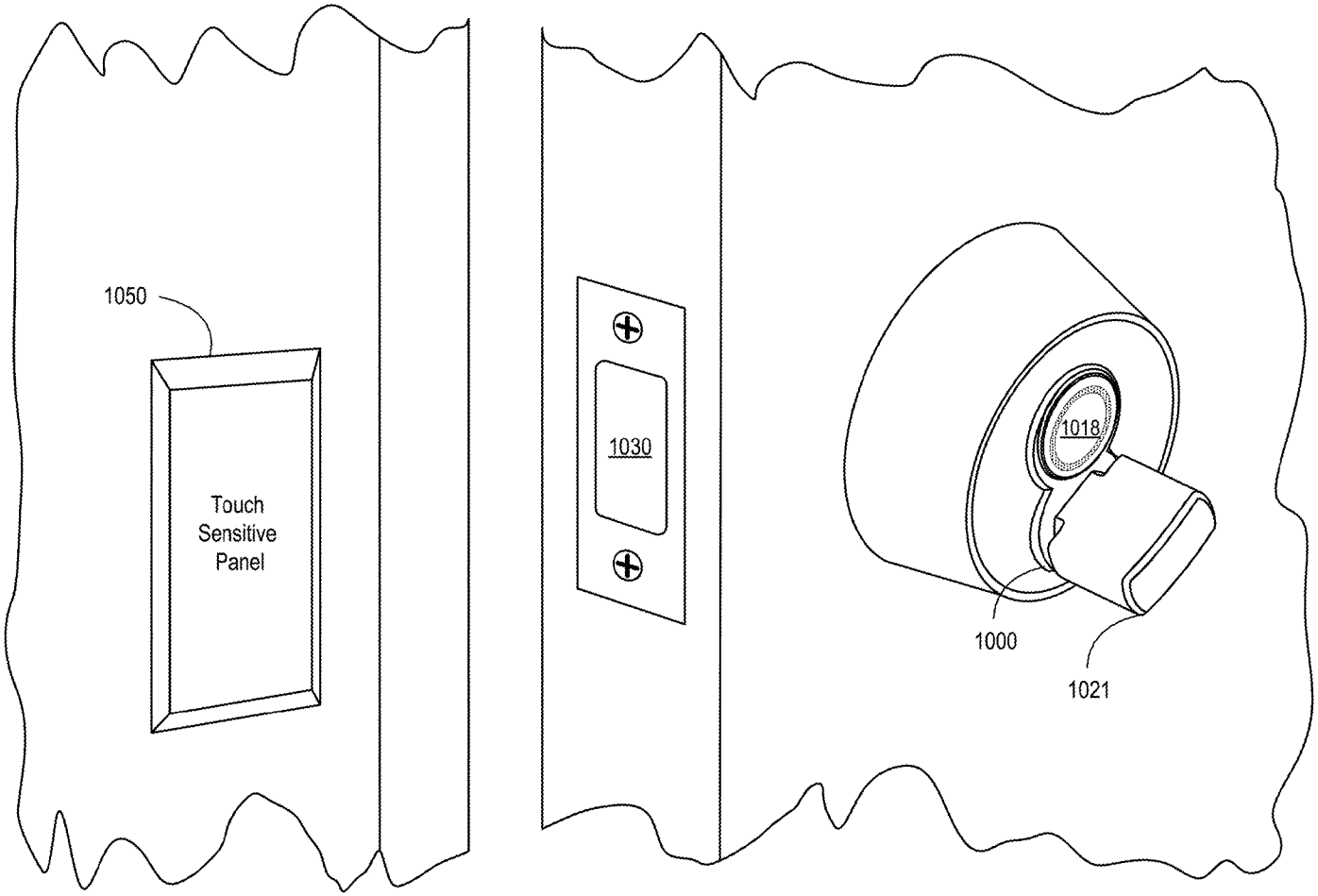
FIG. 10 illustrates a separate input panel for authenticating the wireless-enabled SFIC locking core, according to one embodiment.

FIG. 10 illustrates a separate input panel 1050 for authenticating the wireless-enabled SFIC locking core 1000, according to one embodiment. The input panel 1050 may be remotely located from the wireless-enabled SFIC locking core 1000. For example, the input panel 1050 may be on a different wall. In some embodiments, the button cap 1018 may be pressed to activate the wireless-enabled SFIC locking core 1000 (i.e., transition it from an idle state to an "active" or listing state). The operator may then authenticate via a wireless device, such as a laptop, dedicated key fob, mobile phone, tablet, watch, wearable tech, etc. For example, an application running in the background of a mobile phone may detect the transition of the wireless-enabled SFIC locking core 1000 transitioning from the idle state to an active state. The application running in the background of the mobile phone may automatically transmit an authentication code to the wireless-enabled SFIC locking core 1000. Upon authentication, the user may rotate the handle 1021 to unlock (or lock) the deadbolt or another locking mechanism 1030.

Figure 11:
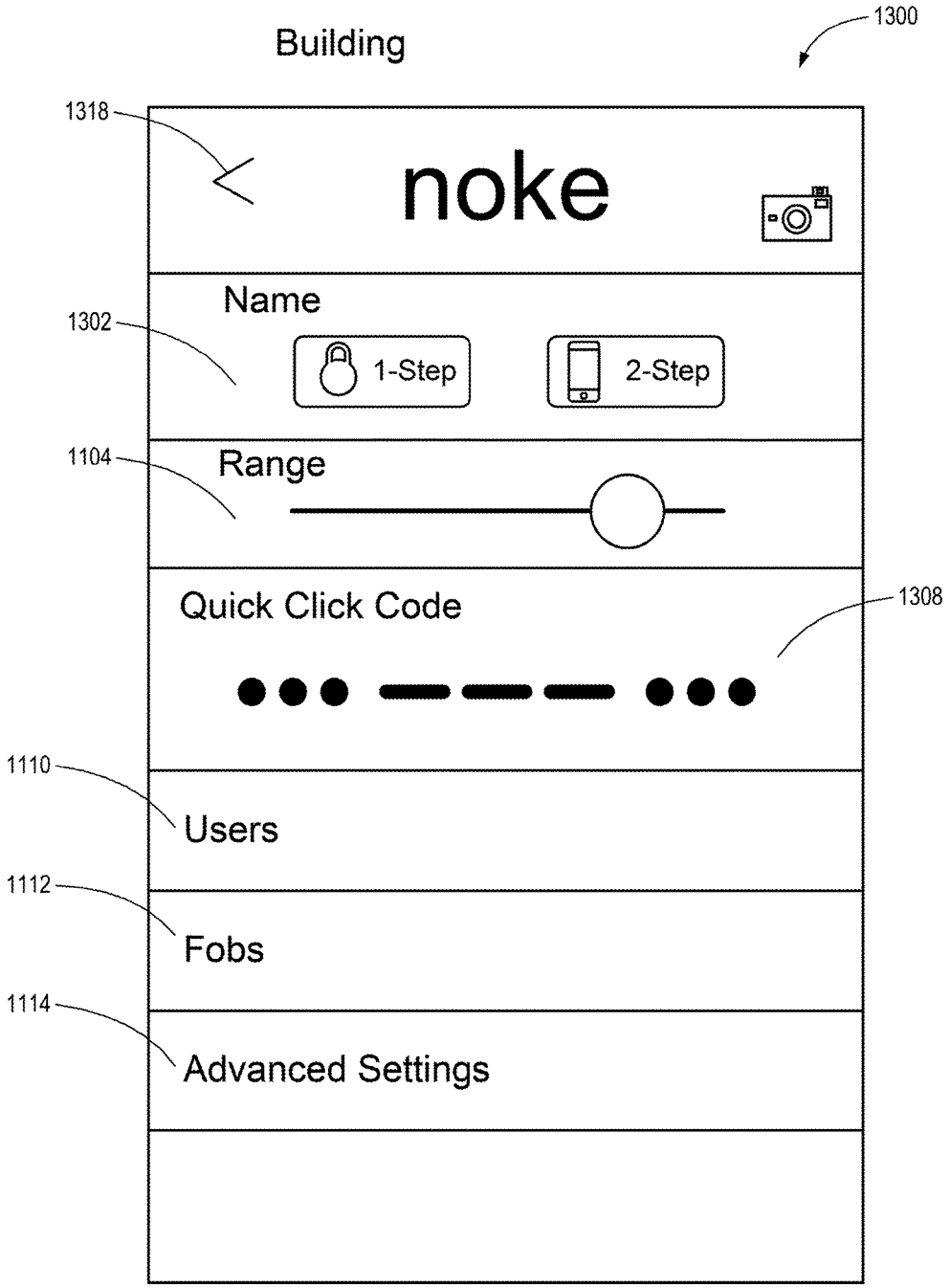
FIG. 11 illustrates a portion of an interface of a software program for actuating, controlling, and configuring a wireless-enabled interchangeable locking core, such as a wireless-enabled SFIC locking core.

FIG. 11 illustrates a portion of an interface 1100 of a software program for actuating, controlling, and configuring a wireless-enabled interchangeable locking core, such as a wireless-enabled SFIC locking core. A user may access an application with the illustrated interface on a laptop, computer, mobile phone, tablet, etc. In some embodiments, a user interface of the application may allow a mobile device to be paired with a wireless-enabled SFIC locking core for faster access in the future. In some embodiments, a locking core may be programmed with a default set of inputs for authentication. Providing such inputs may authenticate the lock, allow it to be paired, and/or allow for various configuration settings. In some embodiments, the pairing may include Bluetooth or ZigBee pairing, for example.

As illustrated, a logo of a servicing company and/or hardware manufacturing may be displayed 1118. In some embodiments, the name may be customized by the operator. In some embodiments, a picture can be added to visually associate an image with a specific log.

An authentication option 1102 may be selected as either 1-step or 2-step. In a 1-step authentication, the lock may be activated and then automatically be authenticated by the application running in the background of a mobile device. In such embodiments, users need not remove anything from the pockets or bags. With 1-step authentication, authentication occurs in a single user step. That is, activation of the lock (i.e., transitioning the lock from an idle or sleep state in which little or no power is consumed to an awake state in which the lock is listening and/or pinging mobile devices to request wireless authentication therefrom) is all that is required to authenticate the lock and allow it to be unlocked.

In 2-step authentication mode, the lock may be activated from the idle state, but the application will not automatically provide the authentication information—even if it is running in the background. Instead, the user must open the application and select an "unlock" option to send the authentication signal to the lock.

In some embodiments, a distance range 1104 may be selected by a slider or by inputting actual numbers to select a distance at which the mobile device will be able to send the authentication signal to the lock. A small range may require the user to be standing proximate the lock. A large range may allow the user to stand several feet, or even tens or hundreds of feet, from the lock and still have the authentication signal transmitted to an active lock.

For example, if Bluetooth 4.0 is used, the maximum may be about 10 meters (if the communication radius is about 10 meters). Other technologies and version of Bluetooth may allow for longer range, faster communication, and/or lower power consumption. The distance slider 1104 may be selectively moved anywhere between the minimum distance and the maximum distance on the distance scale 1104 to set the distance at which the authorized mobile device can unlock the lock. Accordingly, the distance at which an authorized mobile device can unlock the lock may be set anywhere in the range from the minimum distance to the maximum distance. In some embodiments, the distance between the authorized mobile device and the lock may be determined based, at least in part, on a received signal strength of communications between the mobile device and the lock (e.g., a received signal strength of signals the lock receives from the mobile device, a received signal strength of signals the mobile device receives from the lock, or combinations thereof.

By way of non-limiting example, different distances between the mobile device and the lock may be correlated to different received signal strength levels (e.g., decibel power levels). A processor of the lock, a processor of the mobile device, or a combination thereof may determine the distance between the mobile device and the lock.

In some embodiments, once the authorized mobile device enters within the defined distance from the lock (e.g., which may be detected by the mobile device, the lock, or a combination thereof by a received signal strength reaching a level correlated with the defined distance), the lock may unlock (e.g., automatically upon the mobile device entering within the defined distance from the lock, after further authorization steps, etc.). In some embodiments, the lock may unlock automatically responsive to a detection of the mobile device entering within the defined distance from the lock. In some embodiments, such an automatic unlocking feature may be turned on and off by the user. In some embodiments, additional authorization may be required in addition to the mobile device entering within the defined distance. By way of non-limiting example, a predetermined series of physical interactions with the lock may be required in addition to, or instead of, the mobile device entering within the defined distance from the lock.

In some embodiments, even absent an authorized mobile device (e.g., a user forgot a mobile device or a battery of the mobile device is depleted), the lock may be unlocked using the series of physical interactions (quick-clicks). The pattern of physical interaction or quick-clicks can be displayed 1108 and modified by the user. A dot may represent a short "click" and a dash may represent a long "click." As previously described the term "quick-click" is used in the general sense of requiring physical input interactions of some form, although they may not strictly comprise an actual "click." For example, the series or pattern of physical interactions may be provided via a button, switch, toggle, light sensor, motion sensor, resistive touch sensor, capacitive touch sensor, and/or other physical input sensors.

In one embodiment, each lock comes pre-provisioned with a series of master quick click codes that can be used to reset and/or open the lock. These master quick click codes may be one-time use codes and may be provisioned only by the manufacturer, owner, and/or included in the lock at the time of purchase.

Various users can be authorized to be the owner or administrator of the lock, at 1110. For example, an administrative user can define permissions for an authorized user (and/or invite a new user to accept permissions to the lock). A lock can be identified in a title location and by a picture in a picture location. An authorized user can be identified by a user identifier (such as an email, login, name, phone number, blockchain-based identity, or other identifying information, etc.). Permissions can be tailored to the user. Permissions can be set for permanent or single use, or further refined by days, times, and/or an expiration date applicable to each user Similarly, fobs may be configured to access the lock, at 1112, and various advanced settings may be available, at 1114. For example, various tracking services and data logging information may be available. A lock can communicate with a mobile device and/or a lock application service over a network, such as a local or wide area network. Authentication may be performed in the lock, in the mobile device, and/or via a server. The server may include load balancers capable of decryption, application servers, storage, control servers, and/or a data logging service.

In some embodiments, a user can set up an account with the lock application service using an application on the mobile device. The user registers one or more locks with the application server. The lock application service can store user credentials in storage and associate the user credentials with a locking core identifier (e.g., a unique 16-digit code) for the locking core. The user can then invite other users to join the lock application service and grant other users permissions to the locking core. Permissions can be restricted to days, times, a number of times unlocking is granted, a period of time, a repeating schedule, and/or other restrictions on timing and use of the locking core. Timing restrictions may be based on the mobile device's timer or on the lock application service's timer, which can be accessed directly or via the mobile device's Internet connection. Permissions can be stored in the storage. Third parties may be given different levels of access. For example, an owner of the locking core may have master authority. Owners with master authority may have authority to grant permissions to third parties. For example, if the locking core were used to secure a small business and the owner wanted employees to be able to enter during certain hours, the owner could give each employee permission to access open the front door lock.

That permission could be primary or secondary, where primary may be associated with greater privileges for managers and secondary may be associated with fewer privileges for low-level employees. For instance, a primary authority user may be able to share permissions with other people, whereas the secondary authority user could not. However, at any time the owner, due to the owner's master authority, may revoke any permissions. Depending on the embodiment, permissions can be stored locally on the locking core and/or in the lock application service. For example, when permissions are stored solely by the lock application service, the locking core can be transitioned to an awake state by a user interaction and connect to the mobile device over Bluetooth. The mobile device can transmit credentials to the locking core. The locking core can send the credentials (or a message based on the credentials, e.g., a cryptographic hash) to the lock application service (potentially via the mobile device) for determination of whether the mobile device is authorized to unlock the locking core.

Authentication and/or authorization may be done directly by the locking core or via the mobile device's Internet connection. The lock application service can transmit a message indicating authorization or failure to the locking core and log the attempt in the logging service. If authorization is successful, the locking core can transition to an unlocked state and allow a locking mechanism to be unlocked. If authorization is not successful, the locking core can stay in the same state and provide an indicator of the failure (e.g., light, sound, etc.).

Alternatively, the lock application service may not be queried every time an unlock attempt is made. For example, lock application service verification for a mobile device may be required every time, hourly, daily, weekly, monthly, or never. This may be defined by the owner of the locking core. The more secure the owner wishes the locking core to remain, the more frequently the owner can require lock application service verification. The security level associated with the authentication frequency requirement may be represented by a sliding scale from less secure to more secure in which the most secure option may require a server or third-party authentication permission each time the locking core is accessed. The least secure option may never require a server or third-party authentication permission.

In another example, when permissions are stored solely by the locking core, the locking core can be transitioned to an awake state by a user interaction and connect to the mobile device over Bluetooth. The mobile device can transmit credentials to the locking core. The locking core can determine whether the credentials match credentials available locally to the locking core. If a match is found and the user is authorized, the locking core can transition to a released state to allow the locking mechanism to be rotated by the handle. If the user is not authorized, the locking core can stay in the same state and provide an indicator of the failure (e.g., light, sound, etc.).

In one example, when permissions are stored by the locking core and the lock application service, the locking core can be transitioned to an awake state by a user interaction and connect to the mobile device over Bluetooth. The mobile device can transmit credentials to the locking core. The locking core can determine whether the credentials match credentials available locally to the locking core. If a match is found and the user is authorized, the locking core can transition to the releases state relative to allow the locking mechanism to be actuated. If no match is found, the locking core can send the credentials (or a message based on the credentials, e.g., a cryptographic hash) to the lock application service for determination of whether the mobile device is authorized to unlock the locking core. The lock application service can transmit a message indicating authorization or failure to the locking core and log the attempt in the logging service. If authorization is successful, the locking core can transition to an unlocked state and release the locking mechanism. If authorization is not successful, the locking core can stay in the same state and provide an indicator of the failure (e.g., light, sound, etc.).

In an example, the locking core can transition to an awake state in response to a user interaction (such as pressing on a button cap). The locking core can transmit a beacon over a first communication channel (such as Bluetooth). The mobile device can receive the beacon and transmit proof of receipt of the beacon (or a message based on the beacon, e.g., a cryptographic hash) to the lock application service over a second communication channel (e.g., Wi-Fi or ZigBee). The lock application service can determine whether the mobile device is authorized to unlock the locking core. The lock application service can transmit a message indicating authorization, if successful, to the locking core over the second communication channel (e.g., Wi-Fi) and log the attempt in the logging service.

When an authorization message is received, the locking core can transition to a released state. If authorization is not successful, the locking core can stay in the same state and an application on the mobile device can provide an indicator of the failure (e.g., light, sound, message, etc.). In some embodiments, the beacon can be transmitted over the second communication channel and only one communication channel is used.

Logged history can be made available to a user of the locking core (e.g., an owner, an administrator, an authorized user, etc.). History can include various events, attempts, and permissions related to the locking core. This can include current status of the locking core (locked, unlocked, battery power, etc.), prior status of the locking core, user requests received, failed attempts, successful attempts, network connectivity issues, last updates, updated permissions, accelerometer data, and/or other interactions with the locking core or the lock application service.

For example, a commercial real estate agent may use the locking core to show an office building. Instead of a lock on the door requiring a potential buyer to get a physical key, the locking core would conveniently allow the real estate agent to grant access to the office building to anyone for a limited and potentially specific amount of time. Not only could the real estate agent provide this permission, the agent could also limit it and track how it was used. The real estate agent may view the logged history during or after a showing. For instance, the real estate agent may provide a buyer with permission to access the building between 5:50 PM and 6:50 PM. The real estate agent may be notified that the locking core has been unlocked by the buyer at 5:55 PM and receive another notification that the locking core has been locked at 6:15 PM.

Figure 12:
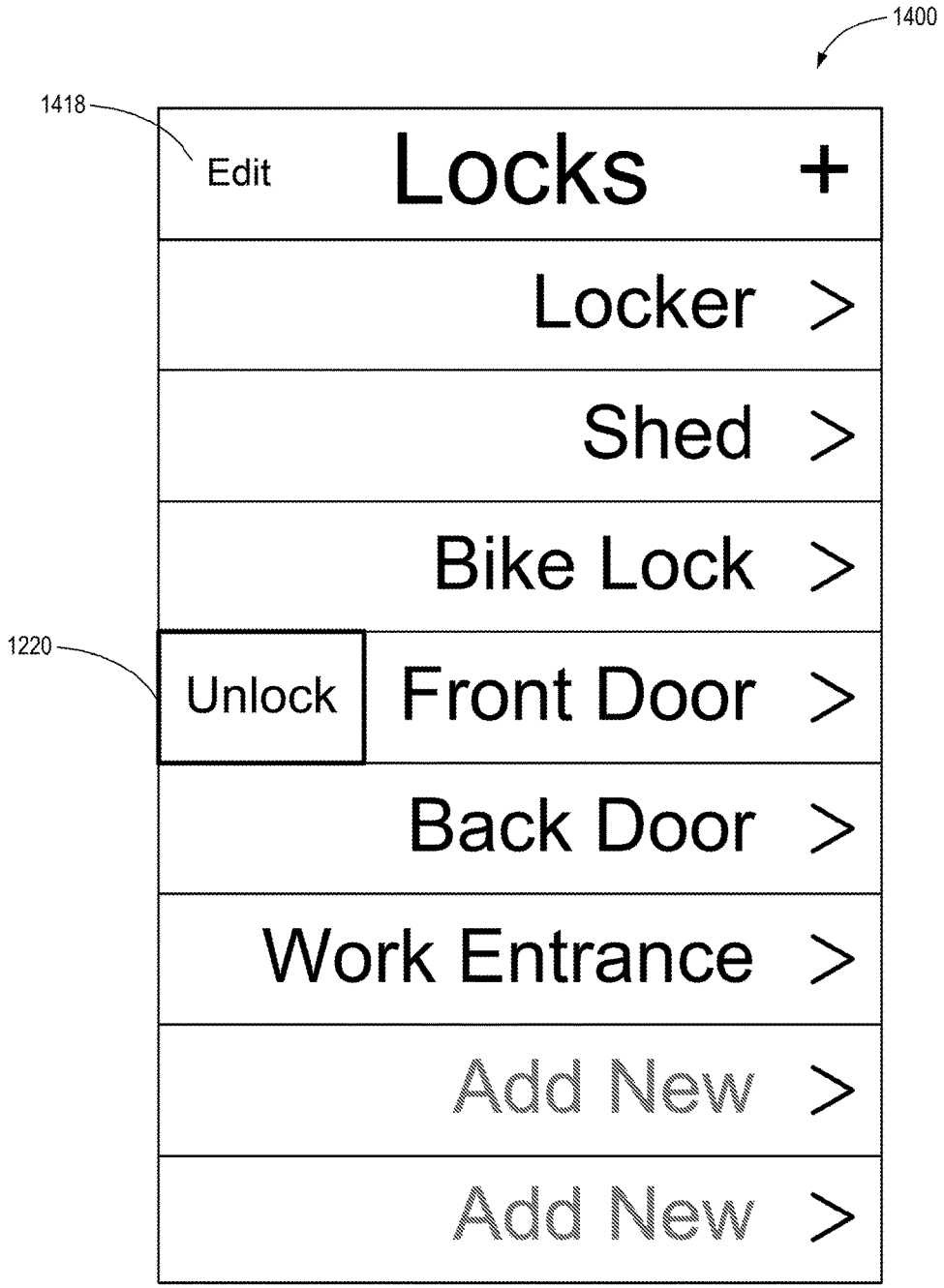
FIG. 12 illustrates another portion of the user interface of the software program for actuating, controlling, and configuring multiple wireless-enabled interchangeable locking cores, according to one embodiment.

FIG. 12 illustrates another portion of the user interface 1200 of the software program for actuating, controlling, and configuring multiple wireless-enabled interchangeable locking cores, according to one embodiment. As illustrated, a number of locks associated with the mobile device executing the application are listed, including a locker, shed, bike lock, front door, back door, and a work entrance. Some of them may be configured in a 1-step authentication configuration, such then when the lock is active (i.e., not in an idle state), the application will automatically send an authentication code to the lock to actuate the lock and allow it to be opened by the user. Other locks, such the front door, may have an "unlock" icon 1220 and be configured in a 2-step authentication configuration. The user must activate the lock (i.e., wake it up) and then open the application and push the "unlock" icon 1220 to send the authentication credentials to the lock.

Figure 13A:
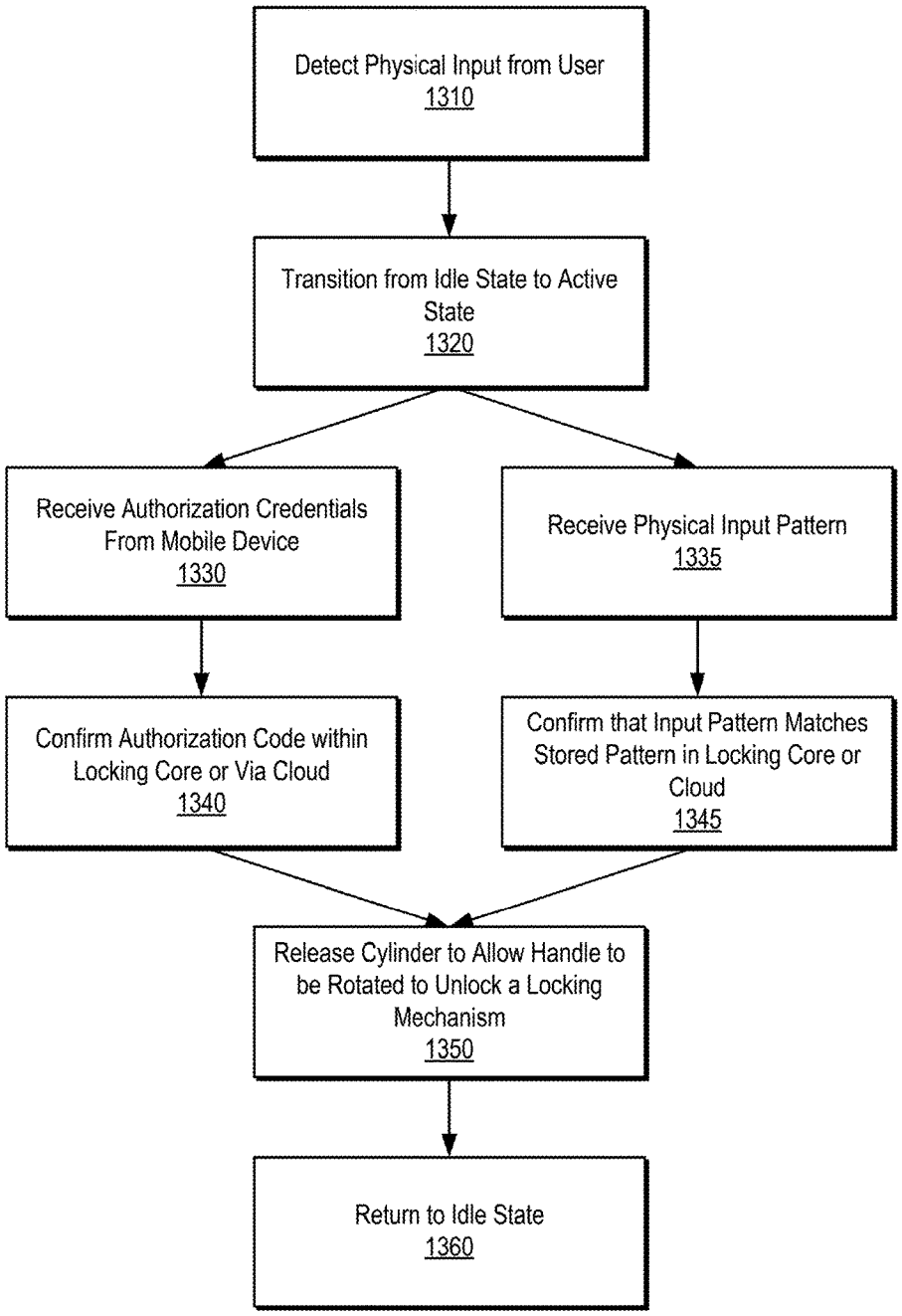
FIG. 13A illustrates one embodiment of a method for unlocking a wireless-enabled interchangeable locking core.

FIG. 13A illustrates a flowchart of a method of operation of a locking core. A locking core may be in a sleep state until physical a physical input is detected, at 1310, by the locking core. The physical input may be a button press, a capacitive interaction with a component connected to the locking core, etc. The locking core may transition, at 1320, from the idle state to an active or activated state. In some embodiments, the transition to the active or activated state may cause the locking core to send a beacon or other query signal.

In one embodiment, an authorized mobile device transmits an authorization signal to the locking core. The locking core receives, at 1330, the authorization signal and confirm that the mobile device is authorized, at 1340, based on information stored within the locking core in memory. In other embodiments, the locking core communicates, via a second communication channel and/or via the mobile device, with a server. The server confirms the authorization signal. In still other embodiments, the mobile device gathers lock identification information from the locking core. The mobile device transmits authorization credential and the lock identification information to the server. The server confirms that the mobile device is authorized to actuate the locking core and an actuation signal is provided by the server to the locking core (via either a second channel or via the mobile device).

Alternatively, a series or pattern of physical inputs are provided, 1335, and the locking core confirms, 1345, that the received pattern corresponds to a stored pattern of inputs. In some embodiments, authentication of the series of physical inputs is handled at the server level as described in any of the embodiments in the preceding paragraph. Once authorized, the cylinder in the locking core is transitioned to a released state and allowed to rotate, 1350, the locking mechanism (such as a deadbolt). In various embodiments, a handle or knob may be rotated or toggled to mechanically move the locking mechanism once the locking core is in the released state. The locking core may then return to an idle state, 1360, to conserve or eliminate the use of power until activated again, at 1310. Failure to authenticate via an authorization signal, 1330, or via physical input patterns, 1335, will prevent the user from actuating the locking mechanism.

Figure 13B:
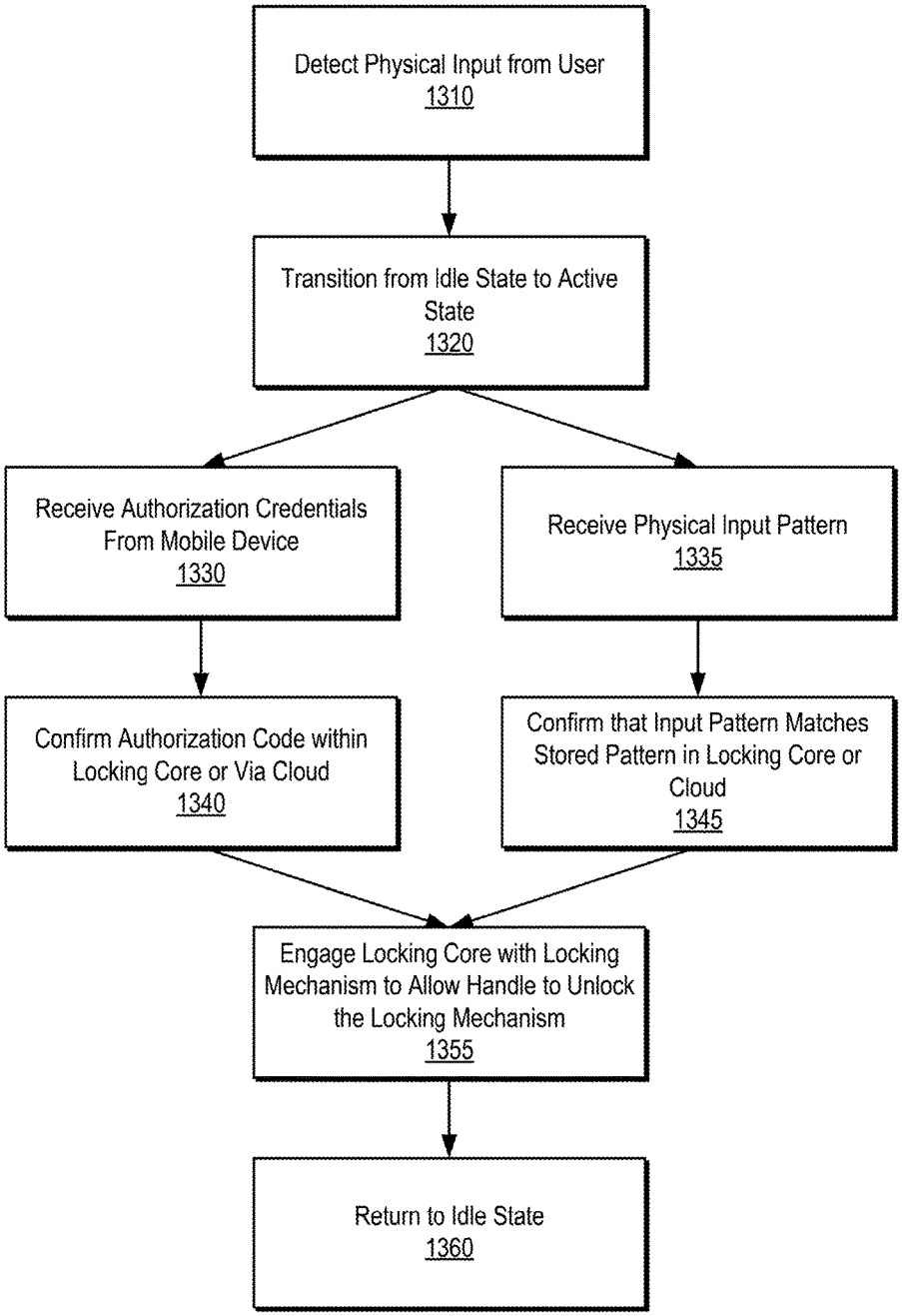
FIG. 13B illustrates another embodiment of a method for unlocking a wireless-enabled interchangeable locking core that engages and disengages from a locking mechanism.

FIG. 13B illustrates another embodiment of a method for unlocking a wireless-enabled interchangeable locking core that engages and disengages from a locking mechanism. Similar to the previously described embodiment, a locking core may be in a sleep state until physical a physical input is detected, at 1310. The locking core may transition, at 1320, from the idle state to an active or activated state. The locking core receives, at 1330, the authorization signal and confirm that the mobile device is authorized, at 1340, based on information stored within the locking core in memory.

Alternatively, a series or pattern of physical inputs are provided, 1335, and the locking core confirms, 1345, that the received pattern corresponds to a stored pattern of inputs. In some embodiments, authentication of the series of physical inputs is handled at the server level as described in any of the embodiments in the preceding paragraph. Once authorized, the cylinder in the locking core engages, at 1355, with a locking mechanism to allow the locking mechanism (such as a deadbolt) to be unlocked. In various embodiments, a handle or knob may be rotated or toggled to mechanically move the locking mechanism once the locking core is engaged with the locking mechanism. The locking core may then return to an idle state, 1360, to conserve or eliminate the use of power until activated again, at 1310.

Failure to authenticate via an authorization signal, 1330, or via physical input patterns, 1335, will result in the locking core not be engaged with the locking mechanism. With the locking core disengaged from the locking mechanism, rotation of the handle will not be mechanically coupled to the locking mechanism and thus will not actuate the locking mechanism. In some embodiments, the handle is prevented from rotating when the locking core is disengaged from the locking mechanism.

Figure 13C:
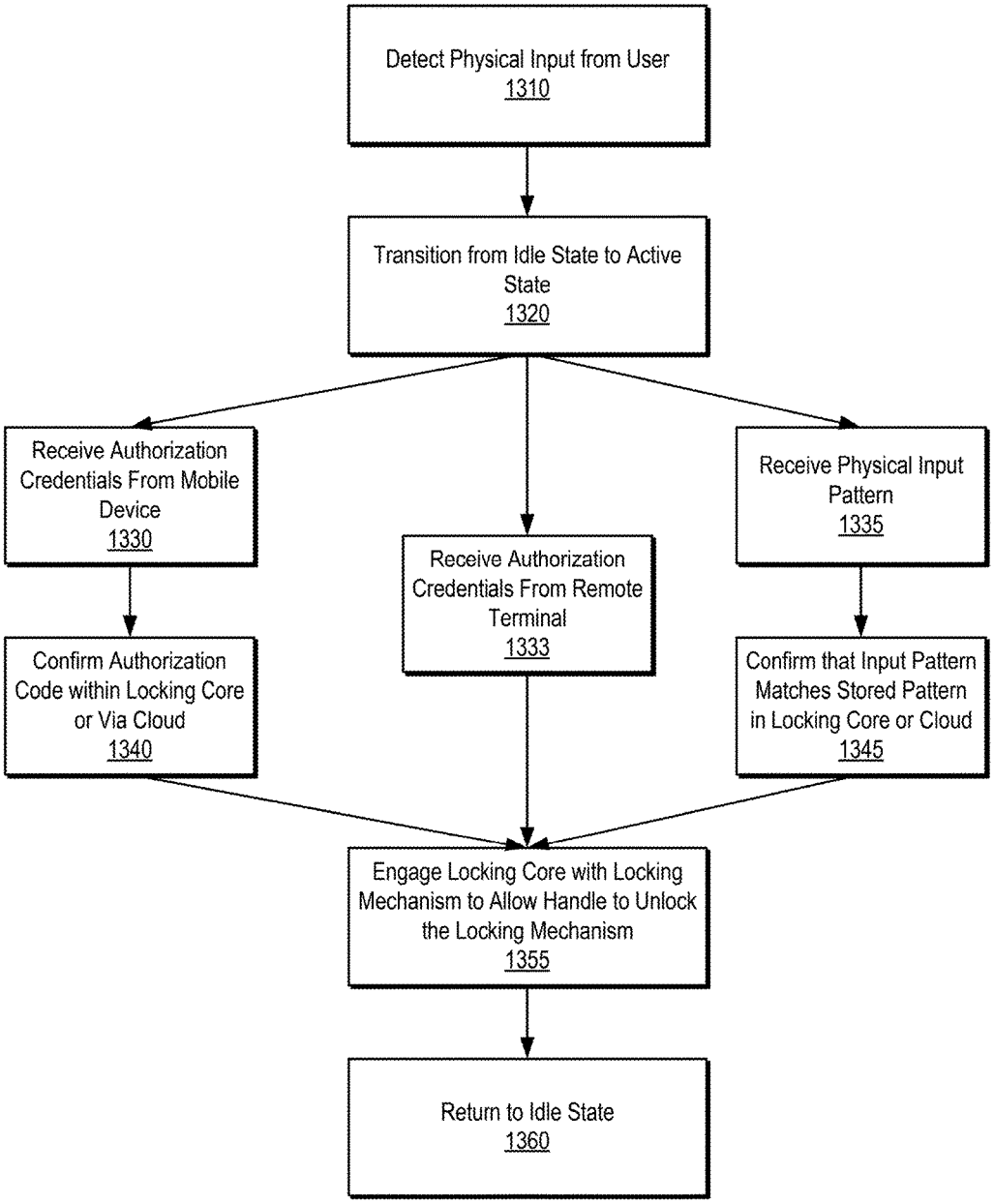
FIG. 13C illustrates another embodiment of a method for unlocking a wireless-enabled interchangeable locking core using a remote terminal.

FIG. 13C illustrates another embodiment of a method for unlocking a wireless-enabled interchangeable locking core using a remote terminal. The illustrated embodiment is similar to the embodiment described in conjunction with FIG. 13B and so identical steps are not described again. However, a third authentication option is presented in which the locking core receives, at 1333, authorization credentials from a remote terminal. Thus, the locking core is engaged, at 1355, with the locking mechanism to allow the handle to unlock the locking mechanism based on (i) received authorization credentials from a nearby mobile device, at 1330; (ii) received authorization credentials from a remote terminal (e.g., a laptop, tablet, remote mobile phone, etc.), at 1333; and/or (iii) a received physical input pattern, at 1335.

In some embodiments, multiple authentications are required before the locking core is engaged with the locking mechanism. For example, a user may be required to provide authorization credentials via a mobile device, at 1330, and input a physical input pattern, at 1335, and/or have the authorization confirmed by a supervisor at a remote terminal, at 1333.

Figure 14:
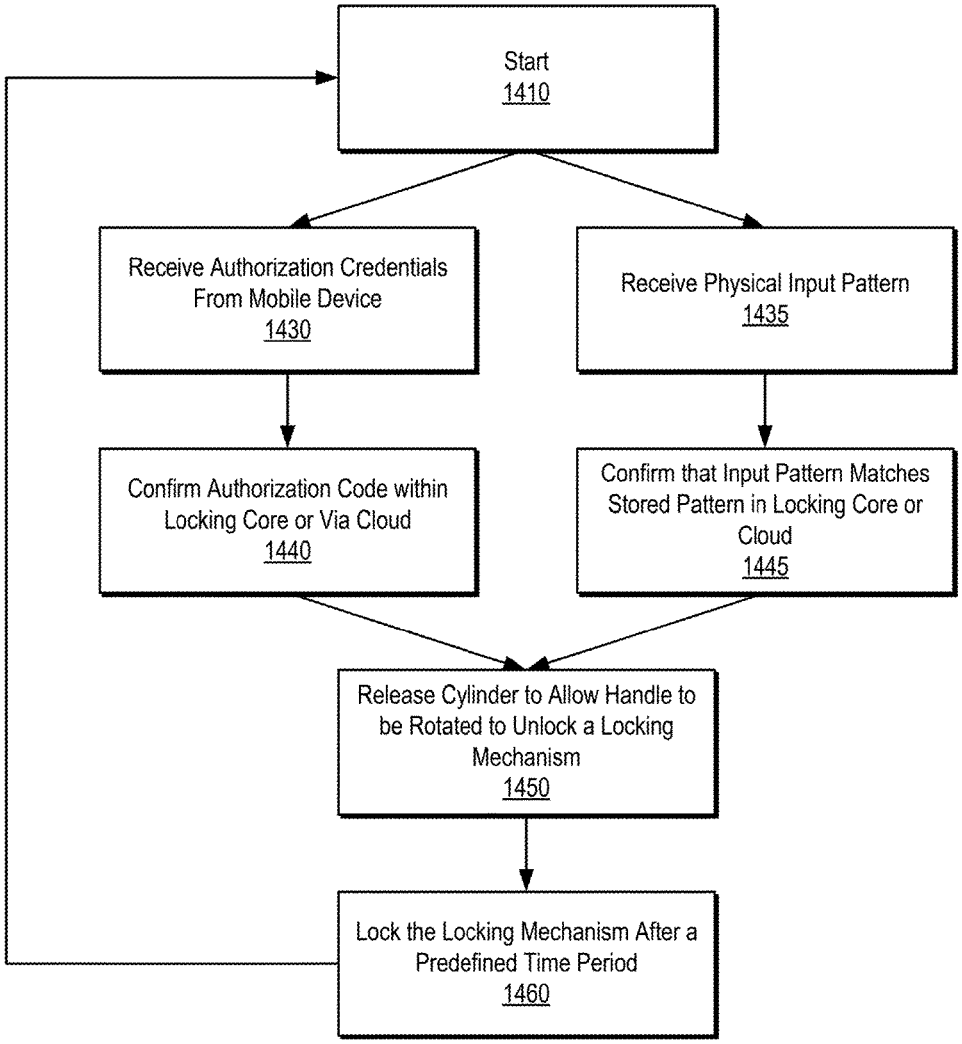
FIG. 14 illustrates another embodiment of a method for unlocking a wireless-enabled interchangeable locking core that remains in an active state.

FIG. 14 illustrates another embodiment of a method for unlocking a wireless-enabled interchangeable locking core that remains in an active state. As illustrated, the locking core is ready to start, at 1410, without having to transition between an idle and active state. Thus, the locking core receives, at 1430, the authorization signal and confirm that the mobile device is authorized, at 1440, based on information stored within the locking core in memory.

Alternatively, a series or pattern of physical inputs are provided, 1435, and the locking core confirms, 1445, that the received pattern corresponds to a stored pattern of inputs. In some embodiments, authentication of the series of physical inputs is handled at the server level as described in any of the embodiments in the preceding paragraph. Once authorized, the cylinder in the locking core is released (or alternatively engaged with the locking mechanism) and allowed to rotate, 1450, to unlock a locking mechanism (such as a deadbolt). In various embodiments, a handle or knob may be rotated or toggled to mechanically move the locking mechanism once the locking core is released/engaged. The locking core may optionally secure or disengage the locking core from the locking mechanism after a predefined period of time, at 1460.

This disclosure has references various embodiments, including the best mode. However, those skilled in the art will recognize that changes and modifications may be made to the embodiments without departing from the scope of the present disclosure. While the principles of this disclosure have been shown in various embodiments, many modifications of structure, arrangements, proportions, elements, materials, and components may be adapted for a specific environment and/or operating requirements without departing from the principles and scope of this disclosure. These and other changes or modifications are intended to be included within the scope of the present disclosure.

This disclosure is to be regarded in an illustrative rather than a restrictive sense, and all such modifications are intended to be included within the scope thereof. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element.

What is claimed is:

1. A wireless, electronic locking core insertable into a core receptacle of a lock assembly to selectively actuate a locking mechanism of the lock assembly, the insertable locking core comprising:

an outer housing;

an external handle;

a lock core, that in a released state, is engaged with a locking mechanism and rotatable via the external handle to move the locking mechanism from a locked position to an unlocked position, and in a secured state, is prevented from moving the locking mechanism from the locked position to the unlocked position;

a wireless receiver within the insertable locking core to receive wireless transmission containing authorization credentials wirelessly transmitted from a mobile device which is physically separate from the wireless receiver;

an authorization controller to determine a release authorization based on a validation of the authorization credentials received via the wireless receiver; and a locking state controller to transition the locking core from the secured state to the released state based on the release authorization determined by the authorization controller.

2. The insertable locking core of claim 1, further comprising a control tab that selectively secures the insertable locking core within the core receptacle of the lock assembly, wherein the control tab can be electronically actuated to allow the insertable locking core to be removed from the core receptacle of the lock assembly.

3. The insertable locking core of claim 1, further comprising an input detector to detect a pattern of physical input interactions with an electronic sensor, and wherein the authorization controller is further configured to determine a release authorization based on a validation of the pattern of physical inputs via the input detector.

4. The insertable locking core of claim 3, wherein the pattern of physical input interactions with the electronic sensor comprises an ordered pattern of long interactions and short interactions, wherein short interactions are distinguished from long interactions based on a defined threshold length of time between 1 and 3 seconds.

5. The insertable locking core of claim 3, wherein the pattern of physical input interactions with the electronic sensor comprises an ordered pattern of interactions that vary in intensity.

6. The insertable locking core of claim 3, wherein the electronic sensor comprises a button and the input detector is configured to detect a pattern of short and long button presses.

7. The insertable locking core of claim 6, wherein a first received button press via the button causes the insertable locking core to transition out of an idle state.

8. The insertable locking core of claim 7, wherein the idle state is one of a low-power and a no-power state.

9. The insertable locking core of claim 3, wherein the electronic sensor comprises a touch sensitive device and the input detector is configured to detect a pattern of short and long touches.

10. The insertable locking core of claim 3, wherein the authorization controller comprises a processor and a memory, and wherein the processor is configured to determine the release authorization based on validation of at least one of the authorization credentials and the pattern of physical inputs matching stored values in the memory.

11. The insertable locking core of claim 3, further comprising a wake-up sensor to receive a wake-up input that causes the insertable locking core to transition out of an idle state, and wherein the electronic sensor is located remotely from the insertable locking core, and wherein the input detector is configured to detect the pattern of physical input interactions by receiving a wireless communication from the electronic sensor only after the insertable locking core has been transitioned out of the idle state.

12. The insertable locking core of claim 1, wherein in the secured state, the lock core is one of:

disengaged from the locking mechanism, and prevented from being rotated by the external handle.

13. The insertable locking core of claim 1, wherein in the secured state, the handle is disengaged from the lock core.

14. The insertable locking core of claim 1, wherein in at least the released state, the lock core is configured to be engaged with a deadbolt locking mechanism.

15. The insertable locking core of claim 1, wherein in at least the released state, the lock core is rotatable via the external handle by one of:

rotating the external handle, and sliding the external handle from a first position to a second position.

16. The insertable locking core of claim 1, wherein the outer housing is configured to be inserted into a small form interchangeable core (SFIC) lock assembly.

17. The insertable locking core of claim 1, wherein the wireless receiver comprises a Bluetooth module to receive authorization credential from a Bluetooth module of a mobile device.

18. The insertable locking core of claim 1, further comprising a wake-up sensor to receive a wake-up input that causes the insertable locking core to transition out of an idle state.

19. The insertable locking core of claim 18, permanently wherein the idle state is one of a low-power and a no-power state.

20. The insertable locking core of claim 16, wherein the external handle is permanently secured to the outer housing of the insertable locking core so as to extend from the SFIC lock assembly.

21. A wireless, electronic locking core for insertion into a core receptacle of a lock assembly to selectively actuate a locking mechanism of the lock assembly, comprising:

an outer housing;

an external handle;

a lock core, that in a released state, is engaged with a locking mechanism and rotatable via the external handle to move the locking mechanism from a locked position to an unlocked position, and in a secured state, is prevented from moving the locking mechanism from the locked position to the unlocked position;

a wireless receiver to receive authorization credentials from a mobile device;

an input detector to detect a pattern of physical input interactions with an electronic sensor, wherein the pattern of physical input interactions comprises an ordered pattern of long interactions and short interactions, wherein short interactions are distinguished from long interactions based on a defined threshold length of time between 1 and 3 seconds;

an authorization controller to determine a release authorization based on one or more of:

a validation of the authorization credentials received via the wireless receiver, and a validation of the pattern of physical inputs via the input detector; and a locking state controller to transition the locking core from the secured state to the released state based on the release authorization determined by the authorization controller.

22. The interchangeable locking core of claim 21, further comprising a control tab that selectively secures the interchangeable locking core within the core receptacle of the lock assembly, wherein the control tab can be electronically actuated to allow the interchangeable locking core to be removed from the core receptacle of the lock assembly.

23. A wireless, electronic locking core for insertion into a core receptacle of a lock assembly to selectively actuate a locking mechanism of the lock assembly, comprising:

an outer housing;

an external handle;

a lock core, that in a released state, is engaged with a locking mechanism and rotatable via the external handle to move the locking mechanism from a locked position to an unlocked position, and in a secured state, is prevented from moving the locking mechanism from the locked position to the unlocked position;

a wireless receiver to receive authorization credentials from a mobile device;

an input detector to detect a pattern of physical input interactions with an electronic sensor, wherein the electronic sensor comprises a button and the input detector is configured to detect the pattern of short and long button presses;

an authorization controller to determine a release authorization based on one or more of:

a validation of the authorization credentials received via the wireless receiver, and a validation of the pattern of physical inputs via the input detector; and a locking state controller to transition the locking core from the secured state to the released state based on the release authorization determined by the authorization controller.

24. The interchangeable locking core of claim 23, wherein a first received button press via the button causes the interchangeable locking core to transition out of an idle state.

25. The interchangeable locking core of claim 23, wherein the idle state is one of a low-power and a no-power state.

26. The interchangeable locking core of claim 23, further comprising a control tab that selectively secures the interchangeable locking core within the core receptacle of the lock assembly, wherein the control tab can be electronically actuated to allow the locking core to be removed from the core receptacle of the lock assembly.

27. A wireless, electronic locking core for insertion into a core receptacle of a lock assembly to selectively actuate a locking mechanism of the lock assembly, comprising:

an outer housing;

an external handle;

a lock core, that in a released state, is engaged with a locking mechanism and rotatable via the external handle to move the locking mechanism from a locked position to an unlocked position, and in a secured state, is prevented from moving the locking mechanism from the locked position to the unlocked position;

a wireless receiver to receive authorization credentials from a mobile device;

an input detector to detect a pattern of physical input interactions with an electronic sensor, wherein the electronic sensor comprises a touch sensitive device and the input detector is configured to detect a pattern of short and long touches;

an authorization controller to determine a release authorization based on one or more of:

a validation of the authorization credentials received via the wireless receiver, and a validation of the pattern of physical inputs via the input detector; and a locking state controller to transition the locking core from the secured state to the released state based on the release authorization determined by the authorization controller.

28. The interchangeable locking core of claim 27, further comprising a control tab that selectively secures the interchangeable locking core within the core receptacle of the lock assembly, wherein the control tab can be electronically actuated to allow the interchangeable locking core to be removed from the core receptacle of the lock assembly.

29. A wireless, electronic locking core for insertion into a core receptacle of a lock assembly to selectively actuate a locking mechanism of the lock assembly, comprising:

an outer housing;

an external handle;

a lock core, that in a released state, is engaged with a locking mechanism and rotatable via the external handle to move the locking mechanism from a locked position to an unlocked position, and in a secured state, is prevented from moving the locking mechanism from the locked position to the unlocked position;

a wireless receiver to receive authorization credentials from a mobile device;

an input detector to detect a pattern of physical input interactions with an electronic sensor;

an authorization controller to determine a release authorization based on one or more of:

a validation of the authorization credentials received via the wireless receiver, and a validation of the pattern of physical inputs via the input detector;

a locking state controller to transition the locking core from the secured state to the released state based on the release authorization determined by the authorization controller; and a wake-up sensor to receive a wake-up input that causes the locking core to transition out of an idle state, wherein the electronic sensor is located remotely from the locking core, and wherein the input detector is configured to detect the pattern of physical input interactions by receiving a wireless communication from the electronic sensor only after the interchangeable locking core has been transitioned out of the idle state.

30. The interchangeable locking core of claim 29, further comprising a control tab that selectively secures the interchangeable locking core within the core receptacle of the lock assembly, wherein the control tab can be electronically actuated to allow the interchangeable locking core to be removed from the core receptacle of the lock assembly.

* * * * *